US006832407B2

(12) United States Patent
Salem et al.

(10) Patent No.: US 6,832,407 B2
(45) Date of Patent: Dec. 21, 2004

(54) MOISTURE INDICATOR FOR WET PICK-UP SUCTION CLEANER

(75) Inventors: Jay M. Salem, Akron, OH (US); Evan A. Gordon, Canton, OH (US); Mark J. Josef, Mogadore, OH (US); Ronald D. Schneider, North Canton, OH (US)

(73) Assignee: The Hoover Company, North Canton, OH (US)

( * ) Notice: Subject to any disclaimer, the term of this patent is extended or adjusted under 35 U.S.C. 154(b) by 140 days.

(21) Appl. No.: 09/818,161

(22) Filed: Mar. 27, 2001

(65) Prior Publication Data

US 2002/0042965 A1 Apr. 18, 2002

Related U.S. Application Data

(63) Continuation-in-part of application No. 09/648,204, filed on Aug. 25, 2000, now Pat. No. 6,812,847.

(51) Int. Cl.[7] ..... A47L 5/00

(52) U.S. Cl. ..... 15/319; 15/320; 340/604; 340/620

(58) Field of Search ..... 15/320, 321, 319, 15/339, 353; 340/604, 605, 620

(56) References Cited

U.S. PATENT DOCUMENTS

| | | | | |
|---|---|---|---|---|
| 4,374,379 A | | 2/1983 | Dennison, Jr. | 340/604 |
| 4,418,712 A | | 12/1983 | Braley | 137/312 |
| 4,896,142 A | | 1/1990 | Aycox et al. | 340/604 |
| 4,912,587 A | | 3/1990 | Kurz | 361/24 |
| 5,205,014 A | * | 4/1993 | Yoo | 15/353 |
| 5,267,370 A | | 12/1993 | Worwerg | 15/319 |
| 5,613,261 A | * | 3/1997 | Kawakami et al. | 15/98 |
| 5,613,271 A | * | 3/1997 | Thomas | 15/321 |
| 5,850,668 A | | 12/1998 | Berfield et al. | 15/353 |
| 5,918,344 A | | 7/1999 | Crevling, Jr. et al. | 15/339 |
| 6,049,940 A | | 4/2000 | Robitaille | 15/319 |
| 6,167,587 B1 | * | 1/2001 | Kasper et al. | 15/320 |
| 6,167,588 B1 | * | 1/2001 | Dyson | 15/339 |
| 6,446,302 B1 | * | 9/2002 | Kasper et al. | 15/319 |
| 6,505,379 B2 | * | 1/2003 | Keller | 15/339 |

FOREIGN PATENT DOCUMENTS

| | | | |
|---|---|---|---|
| JP | 7-124076 | * | 5/1995 |

* cited by examiner

*Primary Examiner*—Terrence R. Till
(74) *Attorney, Agent, or Firm*—A. Burgess Lowe; Brett A. Schenck

(57) ABSTRACT

The moisture sensor and indicator for a wet pickup vacuum cleaner, more particularly a wet extraction type carpet cleaner, is positioned in the suction duct to sense when water droplets or moisture is traveling through the suction duct. An indicator is activated to indicate to the operator that water is being extracted from the carpet. The sensor may alternatively be located in the bottom of the floor-engaging portion where it contracts the floor. When the degree of moisture in the carpet exceeds a predetermined threshold an indicator is activated to indicate to the operator that the floor is still wet and to continue extracting moisture from the floor. Alternatively, the moisture sensor can be used as a safety device on a dry pickup vacuum cleaner. When moisture is detected within the suction duct, the motor-fan assembly of the dry pickup vacuum cleaner is disabled to prevent a potentially hazardous condition. Also, another sensor is positioned in the cleaner to detect when the moisture level of the solution or recovery tank reaches a predetermined level. An indicator is activated to indicate to the operator when the moisture level reaches the predetermined level.

30 Claims, 17 Drawing Sheets

MOISTURE INDICATOR FOR WET PICK-UP SUCTION CLEANER

CROSS REFERENCE TO RELATED APPLICATIONS

This application is a continuation-in-part of application Ser. No. 09/648,204, filed Aug. 25, 2000 now U.S. Pat. No. 6,812,847.

BACKGROUND OF THE INVENTION

1. Field of Invention

This invention relates to a moisture-indicating device for a wet pick-up vacuum cleaner. More particularly, this invention relates to a device for detecting when a wet extraction type carpet cleaner is extracting liquid from a carpet and/or the moisture level of the recovery or solution tank and then indicating such a condition.

2. Description of Prior Art

Upon reviewing consumers operating wet extraction type suction cleaners in their homes, it has been observed that the consumer will often inadequately extract cleaning liquid from some areas of the carpet or even the entire carpet. Some consumers forget to extract any of the cleaning liquid from some areas of the carpet. Failure to adequately extract the cleaning liquid leaves the carpeting wet or overly damp. The carpeting, underlying padding and even the underlying flooring may consequently be damaged by water remaining in the carpet. Leaving the carpet overly damp may also lead to mold and mildew formation in the carpeting, possibly causing damage to the carpeting and creating a possible health hazard. Furthermore, failure to fully extract the soiled cleaning liquid from the carpet leaves dirt in the carpet that would other wise be extracted from the carpet.

There is a need in the art of wet pickup vacuum cleaners and wet extraction type carpet cleaners for a moisture sensor and indicator device that can sense when the cleaner is picking up liquid and indicate such a condition to the operator via an audible or visible signal. Such a device would prompt the operator to continue to pick up liquid from a wet area of carpeting until the cleaner is no longer picking up any liquid. Thus, an operator would be less likely to insufficiently extract liquid from the carpet. The operator can be assured that the soiled cleaning liquid is removed from the carpet to the fullest extent possible and that the carpet is left only slightly damp and will quickly air dry. Moreover, water damage to the carpet and formation of mold would be substantially prevented by proper use of such a moisture sensor and indicator.

Additionally, dry pickup vacuum cleaners are designed to pickup only dry dirt and debris. A motor-fan assembly creates a suction for picking up dirt and debris which is filtered from the airflow by some type of filter assembly. The motor-assembly may be located either upstream of the filter assembly, commonly referred to as a direct air system, or downstream of the filter assembly, commonly referred to as an indirect air system. Exposing either of these two systems to a liquid would create a hazardous condition. The liquid would be drawn into the motor-fan assembly potentially shorting-out the motor. Shorting of the motor will at a minimum damage the motor components and could possibly result in arcing or fire.

Electronic moisture sensing devices are known in the prior art. For example, U.S. Pat. No. 4,374,379 discloses a moisture sensor for pipes that includes a pair of parallel, spaced electrical conductors that run along the lower side of a horizontally extending pipe. Should the pipe begin to leak, the water leaking from the pipe forms drops of water on the lower side of the pipe. The drops of water bridge the gap between the conductors, and thereby activate a circuit that turns on an audible or visible alarm.

An overflow control system for a clothes washing machine is disclosed in U.S. Pat. No. 4,418,712. One of the disclosed embodiments includes spaced electrodes or conductors located in an overflow pipe of a clothes washer. When the water in the overflow pipe bridges the gap between the electrodes, a circuit is activated that turns on an alarm and/or opens a circuit breaker to shut down the washer and prevent overflow of the washer.

U.S. Pat. No. 4,896,142 discloses a moisture detection system for a wet extraction type carpet cleaner that prevents overflow of the recovery tank. The disclosed arrangement includes two conductors mounted in a suction duct of a carpet extractor between the recovery tank and the suction fan. Should any moisture, foam or water overflow the recovery tank and enter the suction duct, the moisture will bridge the gap between the two conductors and thereby activate a circuit that automatically cuts off the power to the motor fan and prevents the moisture from entering the motor.

It is also well know in the prior art to provide dry pickup vacuum cleaners with acoustic or vibration sensors, for example, as disclosed in U.S. Pat. No. 5,608,944, or optical sensors, for example, as disclosed in U.S. Pat. Nos. 4,601,082 and 5,815,884, in order to detect dust flowing through a suction duct in the vacuum cleaner and indicate to an operator that the cleaner is picking up dust. An operator is thus prompted to continue cleaning a given area of carpeting until the sensor no longer detects any dust being picked up by the vacuum cleaners. At which point, the operator may move on to another area of carpeting, assured that the carpet has been fully cleaned before moving on.

The present invention provides a moisture sensing and indicating device for wet pickup vacuum cleaners, especially for carpet extractors, that indicates to an operator when the cleaner is picking up liquid or traveling over a wet area of carpeting.

It is an object of the present invention to provide a moisture sensor for a wet or dry pickup vacuum cleaner, and particularly for a wet carpet extractor or deep cleaner.

It is a further object of the present invention to provide an indicator for indicating to an operator of a wet or dry pickup vacuum cleaner when the cleaner is picking up moisture from the floor or traveling over a wet area of carpeting.

It is a further object of the present invention to provide an electronic sensor that senses the conductance of moisture in the suction duct of a wet or dry pick up vacuum cleaner and thereby determines when liquid is traveling through the duct.

It is a further object of the present invention to provide an optical sensor for determining when moisture and/or water is traveling through a suction duct in a wet or dry pickup vacuum cleaner.

It is a further object of the present invention to provide an acoustical sensor for determining when moisture or water is traveling through a suction duct on a wet or dry pick up vacuum cleaner.

It is a further object of the present invention to provide an electronic moisture sensor in a wet extraction type carpet cleaner that contacts the floor surface and measures the conductivity of the floor to determine when the floor is undesirably wet.

It is a further object of the present invention to provide an optical sensor for determining when moisture and/or water is present within or upon a floor to determine when the floor is undesirably wet.

It is a further object of the present invention to connect a moisture sensor in a wet or dry pickup vacuum cleaner to a circuit that activates an audible or visual alarm, preferably a lamp or buzzer, for indicating when the cleaner is picking up liquid from the floor traveling over a wet area of carpeting.

These and other objects that will become apparent to one of ordinary skill in the art upon reviewing the following description and the appended drawings are achieved by the present invention, which provides a moisture detection system in a wet extraction carpet cleaning appliance to indicate to an operator when the moisture concentration in carpet or other type of work surface has reached an acceptably low level.

SUMMARY OF THE INVENTION

In one illustrated embodiment of the present invention, a moisture detection system includes a moisture sensor which could be of the acoustic, thermal, optical, or conductive type. An electrical signal from the moisture sensor inputs to an appropriate alarm actuating circuit which optically or audibly relays the moisture content status of the carpet or work surface to an operator of the vacuum cleaning appliance.

The moisture detecting sensor according to the invention can either directly measure the moisture content of the carpet or floor surface, or indirectly electronically evaluate the carpet moisture content by monitoring the level of liquid being extracted through the extraction duct of the appliance. In a conductive sensor embodiment of the invention, a pair of spaced-apart conductors are positioned to contact the stream of extracted moisture. A sufficient level of moisture will act to bridge the gap between the conductors, and thereby activate an indicator circuit to indicate to the operator that a wet condition exists. An open circuit between the conductors causes the indicator circuit to communicate to the operator that a dry condition exists. The output signal from the conductors is routed through a buffer and a comparator which switches power between a first indicator lamp indicating a relatively high level of moisture in the floor surface and a second indicator lamp indicating a relatively low level of moisture.

The moisture indicator can be used to measure the moisture level of the floor surface and control the motor-fan assembly accordingly. The moisture indicator is electrically connected to the motor-fan assembly whereby as the cleaner passes over wetter areas of the floor surface, the moisture sensor will detect a greater amount of liquid and the control circuit will increase the power of the motor-fan assembly thus increasing the suction of the cleaner. When the cleaner passes over less wet areas of the floor surface, the moisture sensor will detect a lesser amount of liquid and the control circuit will decrease the power of the motor-fan assembly.

Additionally, the moisture indicator can be used on dry vacuum cleaners to disable power to the motor-fan assembly when moisture is detected on the floor surface or within the duct. When the moisture sensor detect the presence of liquid in the dry vacuum cleaner, the control circuit disconnects the power to the motor-fan assembly via a relay or other semiconductor device thus preventing the potentially hazardous condition of a liquid contacting the field and armature of the electrically charged motor.

Further, another second sensor of the pressure or conductive type can be used to detect the liquid level of the recovery tank.

BRIEF DESCRIPTION OF THE DRAWINGS

Similar numerals refer to similar parts throughout the drawings.

DETAILED DESCRIPTION OF THE INVENTION

Figure 1:
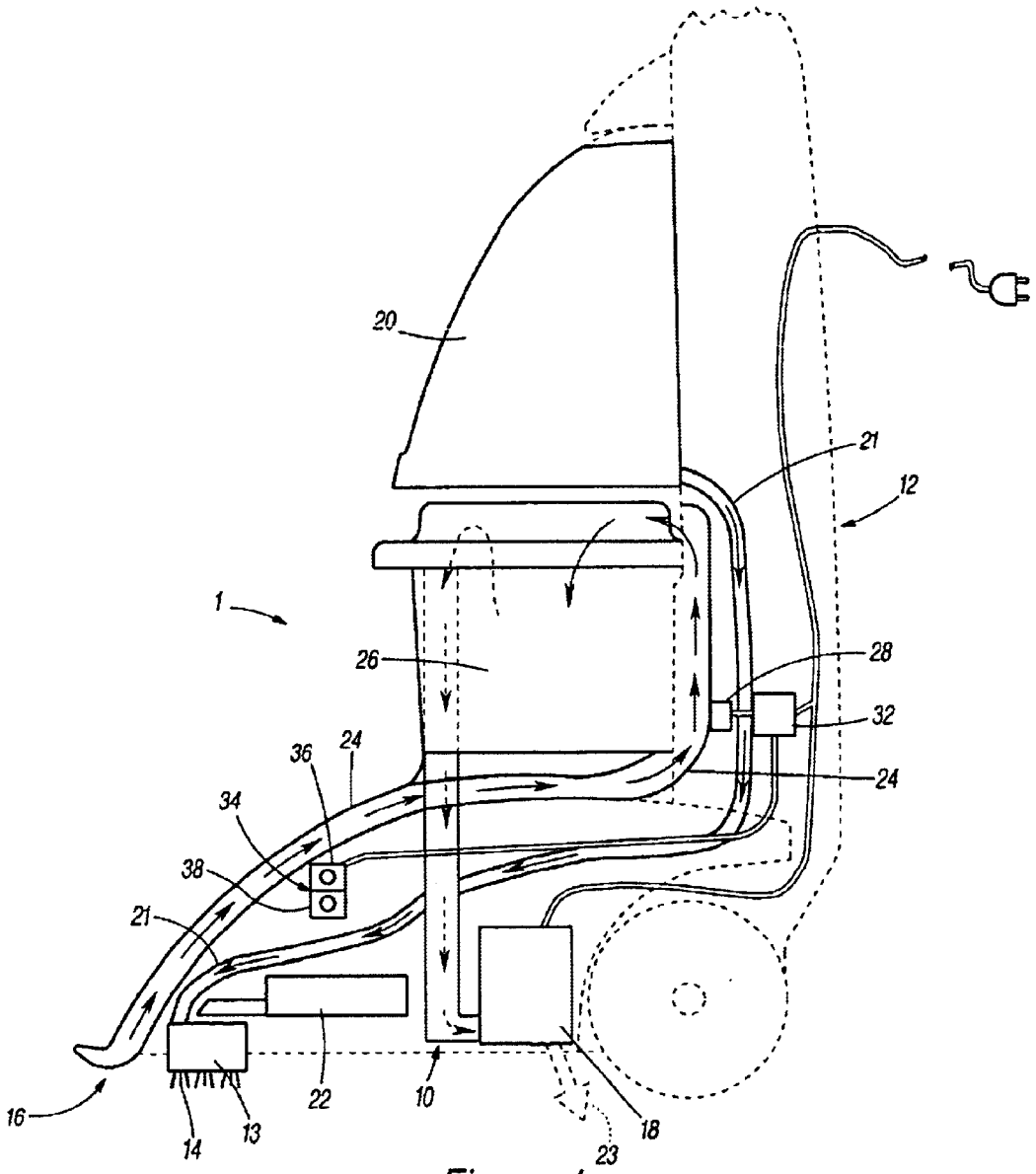
FIG. 1 is a diagrammatic illustration of an upright style wet extraction carpet cleaning appliance provided with a moisture sensor and indicator according to the present invention located in the suction duct.

Referring now to FIG. 1, an upright style carpet extractor 1 is diagrammatically illustrated in ghost in FIG. 1. A typical upright style carpet extractor includes a floor engaging portion 10 and a handle portion 12 pivotally mounted to the floor-engaging portion for propelling the extractor over a floor. The floor engaging portion 10 includes a cleaning liquid distributor 13, a rotary scrub brush 14, a suction nozzle 16 and a suction producing motor fan assembly 18. Cleaning liquid contained in a supply tank 20 is supplied via appropriate tubing 21 to the cleaning solution distributor 13 for application to a floor. Several rotary scrub brushes 14 may be provided which are driven by an appropriate brush motor 22. The cleaning liquid is distributed to the floor surface through scrub brushes 14 and is scrubbed into the floor surface to loosen and dislodge soil from the carpet. The brush motor 22 may be an air-turbine powered by an air flow generated by the motor fan assembly 18, or may be an electric motor which is operatively connected to the scrub brushes for rotation thereof. The motor fan assembly 18 draws air in through the suction nozzle 16 for extracting the soiled cleaning liquid from the carpet. The soiled cleaning liquid travels through a suction duct 24 and into a recovery tank 26 where the liquid-laden is separated from the air and collected in a recovery tank 26. The substantially dry air is drawn into motor-fan assembly 18 and exhausted to the atmosphere, as indicated by arrow 23 of FIG. 1.

Upright carpet extractor 1 has been described by way of example above. Further details of such an upright carpet extractor may be found in U.S. Pat. No. 5,500,977 and in U.S. Pat. No. 5,983,442; the disclosures of these two patents are incorporated herein as a reference.

According to the first mode of the present invention diagrammatically illustrated in FIG. 1, a moisture sensor 28 is located on the suction duct 24 between the suction nozzle 16 and the recovery tank 26. The sensor is preferably located upstream of a bend in the suction duct, such that the moisture contained in the air traveling through the suction duct 24 is propelled against the moisture sensor. The moisture sensor is connected to an indicator actuating circuit 32, which in turn, is connected to an indicator device 34. In the one illustrated embodiment, the indicator device is a pair of colored LED lamps 36, 38. A green lamp 36 is illuminated to indicate a dry area of carpeting and a amber lamp 38 is illuminated to indicate a wet area of carpeting that requires further extraction. Other types of known, commercially available indicator devices, such as one or more audible alarms, may be substituted for the visual indicators of the preferred embodiment if so desired.

Referring still to FIG. 1, when moisture in the form of water droplets, foam or the like is traveling through the suction duct 24, the moisture is detected by the moisture sensor 28. When the sensor detects moisture in the duct, the indicator actuating circuit 32 turns the amber lamp on and turns the green lamp off. The indicator thereby informs the operator that moisture is being extracted from the carpet. Thus, the operator knows that the present section of carpeting is still wet and to continue extracting moisture from this section. When the soiled cleaning liquid has been extracted from the carpet to virtually the desired extent, the extractor will pickup insubstantial quantities of liquid and the sensor 28 will no longer sense liquid in the suction duct 24. In the illustrated embodiment, at this time, the actuating circuit turns off the amber lamp 38 and turns on the green lamp 36. The indicator 34 thereby informs the operator that the present section of carpeting is dry and that it is time to move on to the next section of carpeting.

Figure 2:
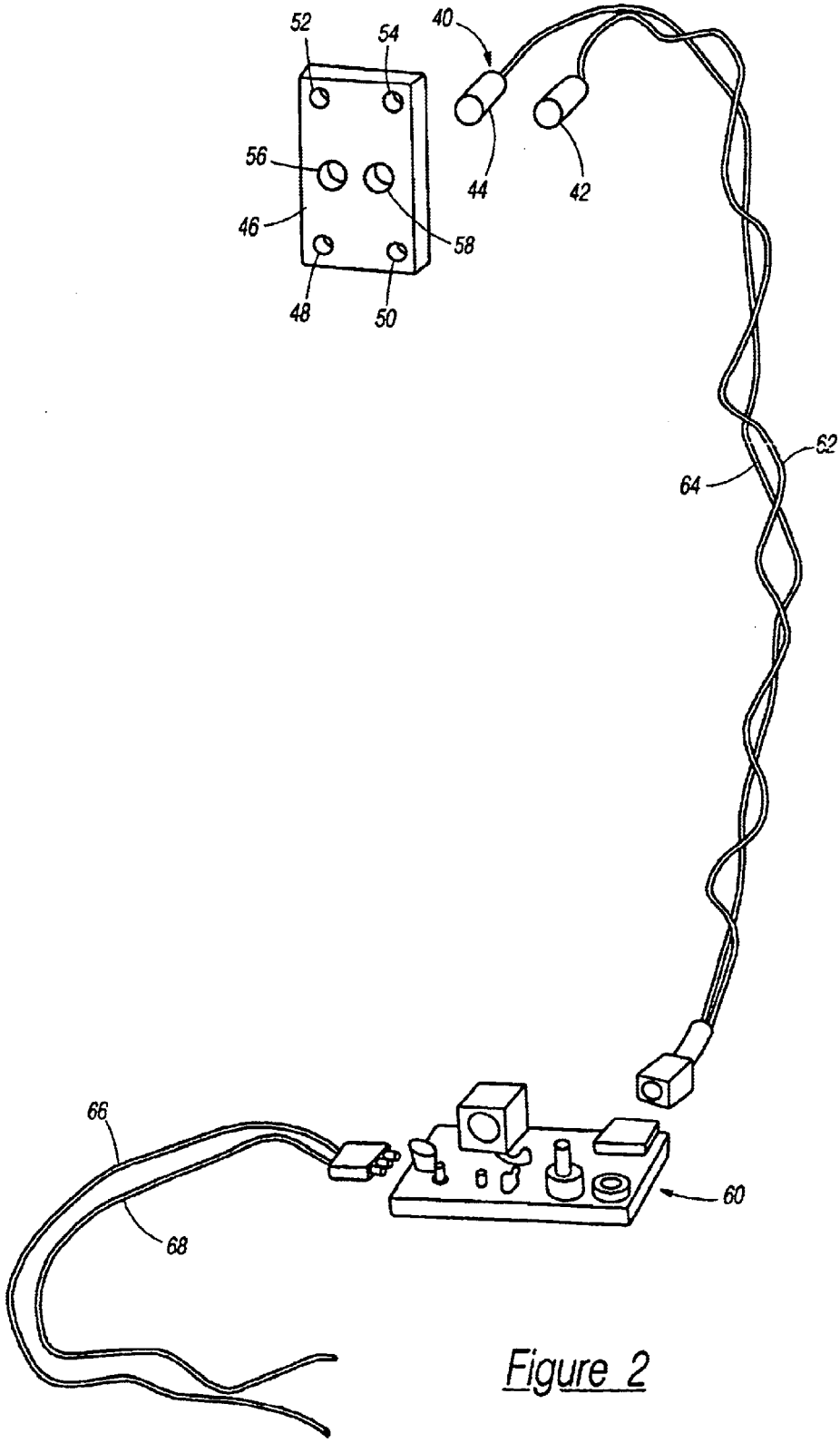
FIG. 2 is a diagrammatic illustration of a conductive sensor according to a first embodiment of the present invention.

In the first embodiment of the present invention diagrammatically illustrated in FIG. 2, the sensor is a conductive sensor 40. The conductive sensor 40 comprises a pair of conductors or electrodes 42 and 44 that are mounted to the internal surface of the suction duct 24. Moisture traveling through the suction duct is propelled against the inner surface of the duct and bridges the gap between the electrodes 42 and 44. Due to the conductivity of the moisture, electricity flows between the electrodes; and the alarm activating circuit (also referred to herein as an "indicator activating circuit") turns the green lamp off and turns the amber lamp on. A generally rectangular mounting plate 46 is provided for positioning the sensor electrodes 42, 44 upon the inner wall of the duct 24. The mounting plate 46 includes four mounting apertures 48, 50, 52, and 54 extending therethrough and positioned proximate respective corners of plate 46. The apertures 48, 50, 52, and 54 are sized to accept suitable attachment hardware such as mounting screws (not shown). A pair of spaced apart through sockets 56, 58 are further provided at a middle portion of plate 46. Electrodes 42, 44 are dimensioned for close receipt within sockets 56, 58, respectively and, so positioned, are maintained with a predetermined separation, which in the present embodiment is approximately ⅜ of an inch. The sensor electrodes 42, 44 are electrically connected to a printed circuit board 60 by means of leads 62, 64. The board 60 transmits control signals to the indicator lamps 36, 38 by means of output leads 66, 68.

Figure 3:
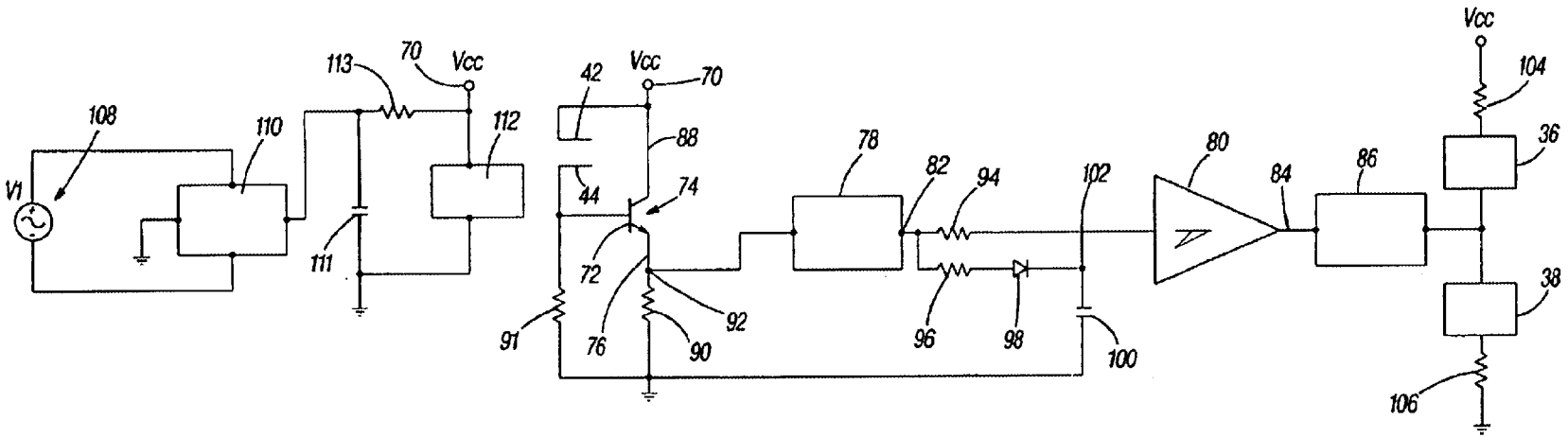
FIG. 3 is a block schematic diagram of an alarm actuating circuit for use in connection with the conductive sensor of FIG. 2.

A suitable alarm actuating circuit for use with a conductive moisture sensor according to the previously described first embodiment of the present invention is diagrammatically illustrated in FIG. 3. Referring to FIG. 3, the conductive sensor and indicator circuit are powered by a 5 volt, direct current power source 70 (Vcc). As discussed above, the electrodes 42 and 44 may be spaced from one another on the internal surface of the suction duct, just downstream of a bend in the duct. One electrode 44 is connected to the base 72 of an npn transistor 74 (commercially available as a Q2N3904). The emitter 76 of the transistor 74 is connected to a buffer 78 for smoothing the voltage output from the transistor. A schmitt trigger comparator 80 is connected to the output 82 of the buffer 78. An output 84 of the comparator 80 is routed through a secondary or display buffer 86 and provides for smooth switching of power from the green indicator lamps 36 to the amber indicator lamp 38.

When moisture bridges the gap between the electrodes, a current flow is established in the base 72 of the transistor 74. The current flowing into the base of the transistor allows current to flow from the collector 88 of the transistor 74 to the emitter 76, thereby establishing a voltage across resistor 90. The voltage across resistor 90 is proportional to the conductivity across the gap between the electrodes 42 and 44. The conductivity across the electrodes is proportional to the quantity of liquid bridging the electrodes, which is proportional to the quantity of liquid traveling through the suction duct 24. When the quantity of moisture in the suction duct exceeds a predetermined level, the detected voltage across the resistor 90 and output to the schmitt trigger comparator 80 exceeds a corresponding predetermined level. The schmitt trigger comparator then switches the indicator green lamp off and the amber lamp on.

The detected voltage signal at 92 exhibits heavy fluctuations due to the turbulence of the moisture flowing across the electrodes 42, 44. Such fluctuation can lead to an incorrect interpretation of the moisture content. Consequently, smoothing of the follower voltage across resistance 90 is achieved by buffer 78 and integration using a dual slope method formed by resistors 94,96; diode 98; and capacitor 100. The schmitt trigger comparator 80 receives an input from junction 102 and gives smooth switching through display buffer 86 to illuminate the amber lamp 38 when the detected moisture level exceeds predetermined levels. Lamp 36 is connected to line voltage Vcc through resistor 104 and lamp 38 is connected to ground through resistance 106.

Alternatively, a microcomputer may be employed in the circuit of FIG. 3 to compare the analog voltage level across resistor 90 with predetermined set levels. An output digital signal from the microprocessor can then be utilized to alternatively illuminate lamps 36, 38. Such a configuration is incorporated into the circuit of the alternative acoustic sensor embodied in FIGS. 4 and 5.

Referring still to FIG. 3, the biasing voltage 70 is derived from alternating current source voltage 108 processed through a rectifying circuit 110 and a regulating circuit 112 comprising capacitance 111 and resistance 113. The input voltage can either be sourced from line or a motor tap.

While the conductive sensor shown in FIGS. 1, 2 and 3 is described above as being mounted to the duct 24 within extractor 1, the subject invention is not intended to be so limited. The electrodes 42, 44 may be mounted by suitable means such as a mounting plate to the underside of the extractor 1, proximate the suction nozzle 16 and positioned to contact the carpet therebeneath. The moisture within the carpet, in such an embodiment, will bridge the gap between the electrodes and cause electricity to flow therebetween. The conductivity of the moisture between the electrodes will be detected by an electronic circuit similar to that described above and shown in FIG. 3 thus causing a switch to occur between color differentiated indicator lamps 36, 38. Mounting the conductance sensor to the underside of the extractor, accordingly, would provide for a direct measurement of the moisture content in the area of carpet occupied by the extractor.

Figure 4:
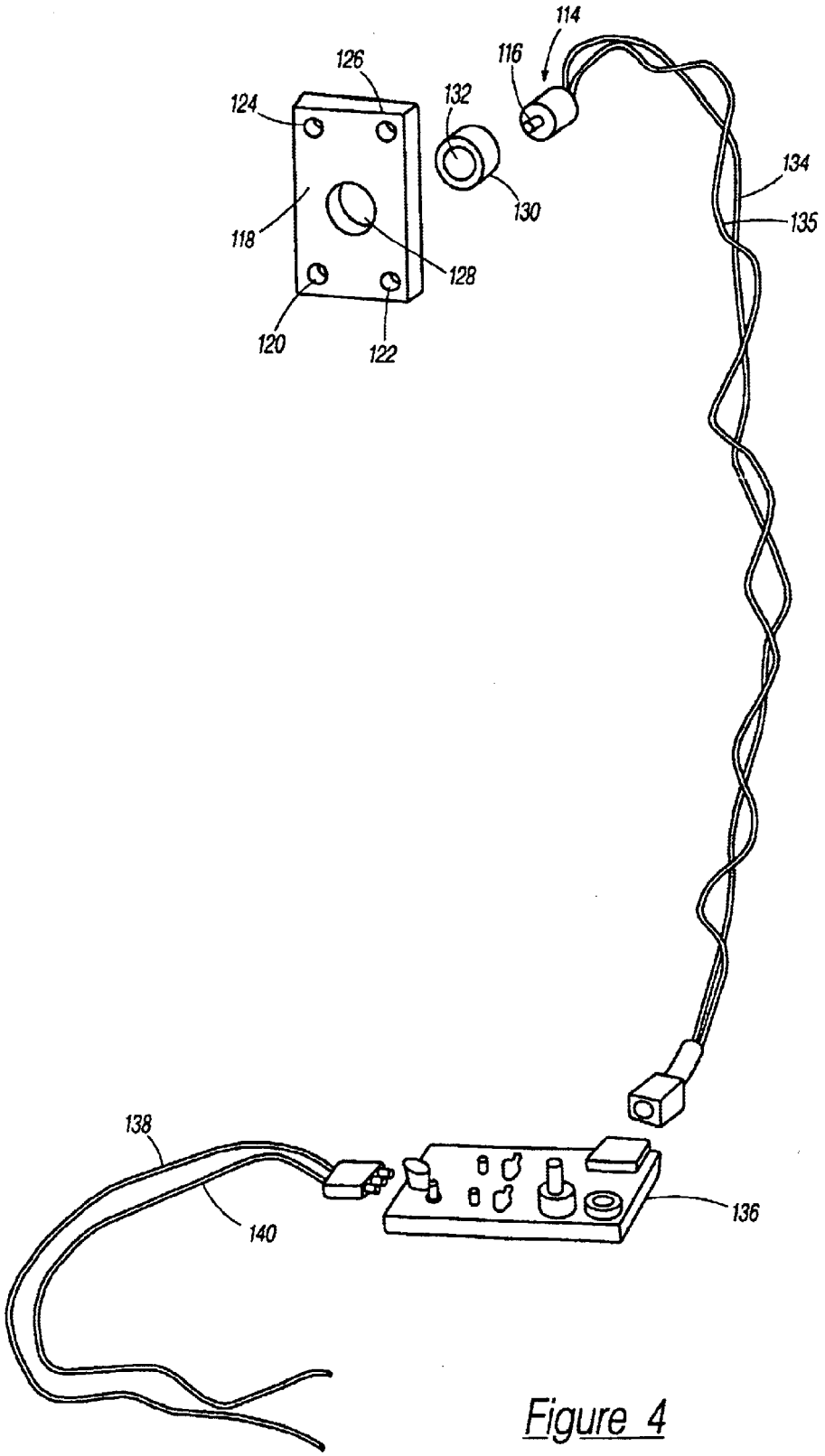
FIG. 4 is diagrammatic illustration of an acoustic moisture sensor according to a second embodiment of the present invention.

FIG. 4 diagrammatically illustrates an alternative acoustic moisture sensor 114 for use in a suction duct according to a second embodiment of the present invention. The acoustic sensor comprises a microphone 116 attached to the outer surface of the suction duct 24 (FIG. 1). The microphone 116 is attached to the suction duct 24 immediately upstream of a bend in the suction duct due to the fact that the moisture in the air traveling to the suction duct impinges against the inner surface of the suction duct at this location. The microphone detects the vibrations and sound created by the moisture in the water droplets in the air when impinged against the inner surface of the suction duct. The microphone and the alarm actuating circuit are substantially the same as the dirt detector for use in upright vacuum cleaners disclosed in U.S. Pat. No. 5,608,944 the disclosure of which is hereby incorporated herein as a reference. When the amount of sound detected by the microphone reaches a predetermined threshold level, the alarm actuating circuit turns the indicator lamp on to indicate to an operator that water is being extracted from the carpet.

A generally rectangular mounting plate 118 is provided having four mounting apertures 120, 122, 124, and 126 extending therethrough positioned proximate respective corners. A central through socket 128 is sized to closely admit and seal in liquid tight fashion against a hollow cap member 130. The microphone 116 is inserted into a rearward open side of the cap member and positioned proximate an enclosed forward wall 132 of the cap member 130. So located, the microphone 116 is protected from direct contact with moisture passing through the duct 24. The microphone 116 is electrically connected to printed circuit board 136 by leads 132, 135. The output signal from the circuitry on board 136 activates lamps 36,38 (not shown in FIG. 4) by means of leads 138,140.

Figure 5:
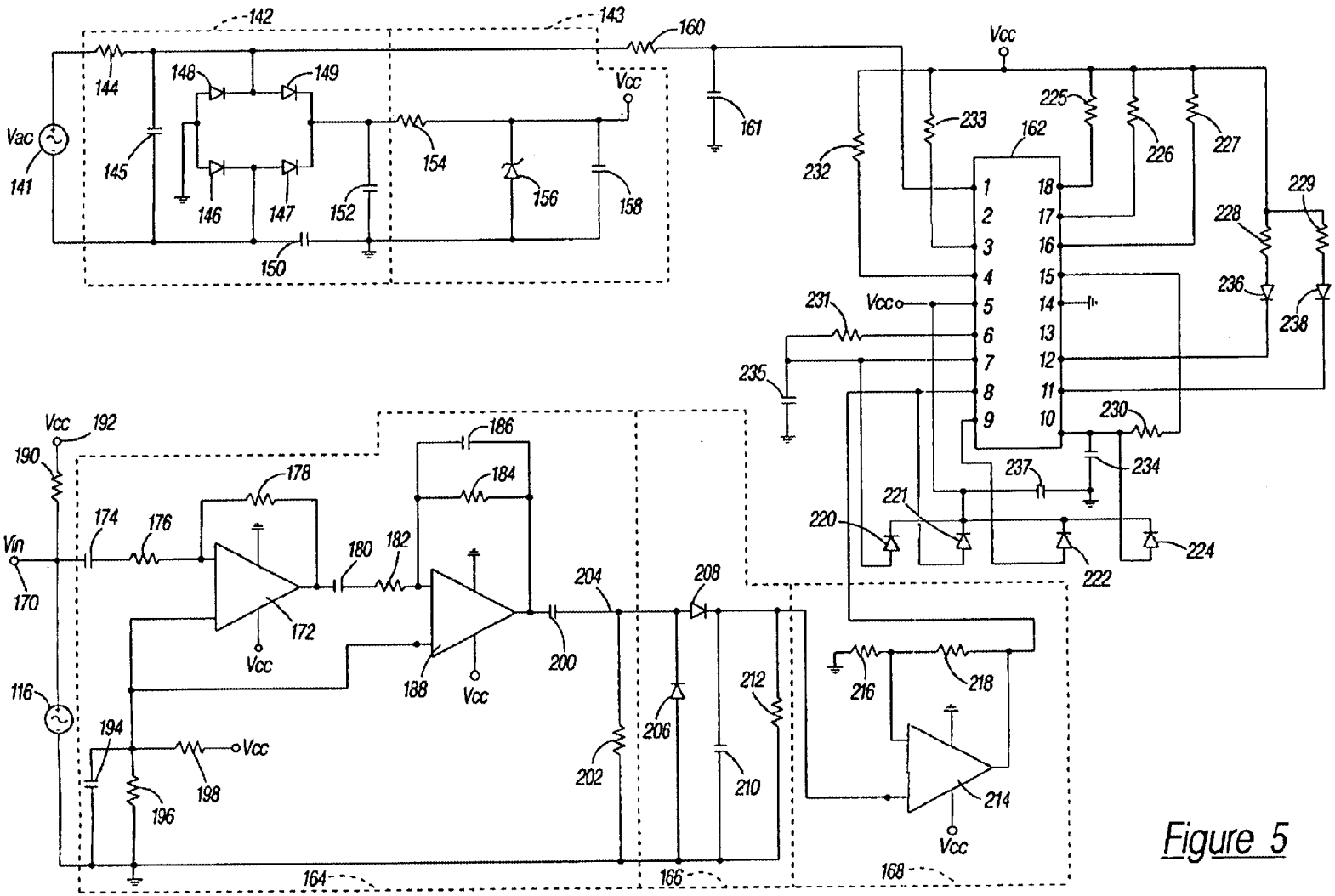
FIG. 5 is a block schematic diagram of an alarm actuating circuit for use in connection with the acoustic sensor of FIG. 4.

Referring now to FIG. 5, a block diagrammatic circuit is illustrated that may be connected to the microphone 116 in FIG. 4. Such a circuit includes an alternating current 12 volt input voltage 141 which is rectified by circuit 142 and regulated by circuit 143. Circuit 142 includes resistor 144, capacitor 145 and a diode bridge rectifier comprising diodes 146, 147, 148, 149. Capacitors 150, 152, 158, resistor 154 and avalanche diode 156 complete the regulator circuit 143 and are employed to provide a constant direct current power source of 5 volts (Vcc). The alternating current power source 141 is coupled through resistor 160 to a microprocessor (commercially available as a Z86E02 chip) for zero crossing detection.

With continued reference to FIG. 5, the detection circuit comprises a microprocessor 162 (Z86E02); an amplifier filter section 164; a diode pump section 166; and an amplification section 168. A conventional audio microphone 116 such as a microphone sold by commercial retailer Radio Shack Corporation as an Electret Condenser Microphone is mounted and positioned as described above on the outer surface of the extractor's recovery duct 24 near a ninety degree bend although it could be positioned adjacent to any turbulent created portion of impingement surface within the air flow duct. So positioned, the microphone will detect sound pressure generated by fluid traveling up the duct to the recovery tank. Small electrical impulses are generated when the surface of the ducting being monitored by the microphone is impinged by turbulent air and liquid. In one embodiment, a frequency analysis of the microphone response show signal to noise ratio of 2 to 1 from 12000 Hz to 40000 Hz range at the microphone output.

In the illustrated embodiment, the electrical signals produced by the microphone 116 by the audible signals occurring through the duct 24 provide pulses within the selected band of frequencies. These pulses are fed to a two stage high pass filter amplifier circuit 164. Amplifier 164 has a formed first stage comprising an operational amplifier 172 (available commercially as an LM324 chip), a capacitor 174 and resistances 176, 178, and a second stage consisting of a capacitor 180, resistance 182,184, feedback bypass capacitor 186, and a second amplifier 188 (LM324). This portion of the circuit amplifies its incoming signal as the capacitors and their associated resistance form a first impedance (Z1) and the other resistance in each stage forms a second impedance (Z2). Because capacitor reactance approaches zero at higher frequencies, only the higher frequency components are amplified. Each of these amplifier's gain is generally given as Vout/Vin=Z2/Z1. A biasing resistor 190 is provided between voltage Vcc at 192 and the circuit 164.

The second terminal of microphone 116 is coupled through shunt capacitor 194 and resistance 196, 198 to line voltage Vcc. The circuit 164 further includes a capacitor 200 and a resistor 202 which form a last stage of high pass filtering at juncture 204. The output of the filter/amplifier section 164 is fed into a diode pump comprising diodes 206 and 208, capacitance 210 and resistance 212. The diode pump circuit 166 converts the audio signal to a mean DC voltage that is subsequently amplified by circuit 168.

Circuit 168 comprises a non-inverting third operational amplifier 214 (LM324), an input resistance 216, and feedback resistance 218. Operational amplifier 214 amplifies the mean DC voltage output from diode pump circuit 166 and inputs the signal into microprocessor 162 (Z86C02). The diode elements 220, 221, 222, and 224 and resistance 225, 226, 227, 228, 229, 230, 231, and 232 and capacitance 233, 234, and 235 are incorporated into line inputs to microprocessor 162 as shown in FIG. 5. The visual indicator LED components 236, 238 are connected between circuit voltage Vcc and microprocessor 162 as shown with diode 236 emitting a green color and diode 238 an amber color. The microprocessor 162 performs an analog to digital conversion on the amplified DC voltage from amplifier 214 and compares the digital data against threshold levels preprogrammed by the manufacturer. At levels exceeding the preset threshold, indicating a wet carpet condition, the microprocessor indicates to the user through the amber LED 238 that the moisture content of the carpet is high and that extraction should continue until the level falls below the preset threshold. At that point, microprocessor 162 switches back to activate the green LED 236, whereby indicating to the user that the carpet is sufficiently dry.

It should be clear from the description offered that all the objects of the invention have been satisfied. It should also be clear that the invention is not confined to the embodiments described herein. Other embodiments which will be apparent to those skilled in the art and which utilize the teachings herein set forth are intended to be within the scope and spirit of the invention. By way of example, without any intent to limit the invention, other types of moisture sensors may be employed to practice the invention. A near infared optical (or thermal) sensor may be utilized for detecting near infared radiation emanating from the carpet area proximate to the extractor. Near infared radiation levels emanating from a wet carpet will be lower than levels emanating from a dry carpet. Measurement of such radiation levels, accordingly, by commercially available near infared detectors can be made and an analog voltage proportionate to the level of near infared radiation can be generated. The analog voltage level can then be amplified and compared against threshold levels set by the manufacture through electronic circuitry similar to that described above. A higher near infared level, above the threshold level set by the manufacturer, will indicate a dry carpet condition and trigger activation of a Green LED indicator to the user. A lower near infared level, below the set threshold level, will indicate a wet carpet condition and trigger activation of an amber LED to the user.

Another embodiment of the invention can be devised employing an optical sensor comprising a transmitter/receiver set. The optical sensor would include a lamp or other light-emitting element located opposite a light receptor. The optical sensor can be positioned across the evacuation duct and measure the amount of moisture or water droplets extracted from a carpet. When moisture or water droplets travel between the light emitter and the light receptor, the wave length for the light being received by the receptor reaches a threshold value, the alarm actuating circuit turns the amber indicator lamp on. A detected level of droplets below the threshold level would cause the alarm actuating circuit to switch the green indicator lamp on.

Yet a further modification can be made utilizing a sensor which reacts chemically to the level of moisture present in a carpet. Such a sensor may be located on the lower surface of the floor engaging portion 10 of the carpet extractor 1 (FIG. 1). The moisture sensor in such a location would be situated so as to rub against the carpet to sense when the carpet contains an undesirable degree of moisture. Signals from a chemical moisture sensor can then be amplified and compared against a predetermined threshold. The result of the comparison will determine whether a wet or dry condition exists. A suitable user-discernible alarm or visual indication device will communicate the status of the floor surface to the user of the appliance.

As discussed previously, a further alternative embodiment of the invention is to redeploy the conductivity sensor shown in FIGS. 2 and 3 to the bottom of extractor 1 so that the sensor can contact the carpet directly. As in the first embodiment of the present invention illustrated in FIG. 2, the conductive moisture sensor would include a spaced-apart pair of electrodes or conductors that contact the carpet. When moisture in the carpet bridges the gap, electric current is able to flow between the two electrodes. Thus, the conductivity of the carpet may be determined by the amount of current flowing between the two electrodes. When the current reaches a pre-determined threshold the alarm actuating circuit turns on an amber indicator lamp. A current below the predetermined threshold will activate a green indicator lamp and disable the amber lamp, whereby signaling that a dry condition exists.

Figure 6:
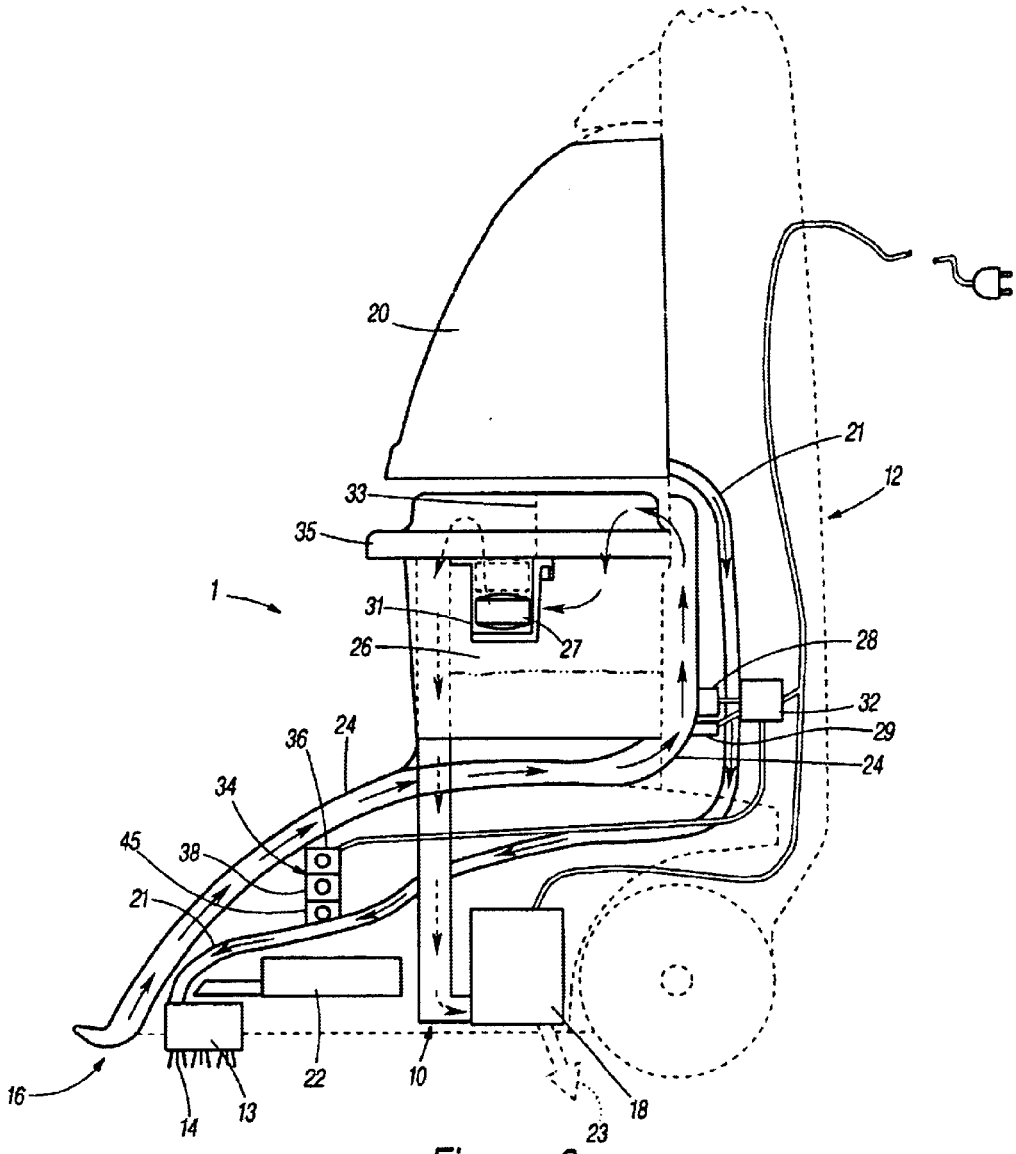
FIG. 6 is a diagrammatic illustration of an upright style wet extraction carpet cleaning appliance provided with two moisture sensors and indicators according to another embodiment of the present invention.
Figure 7:
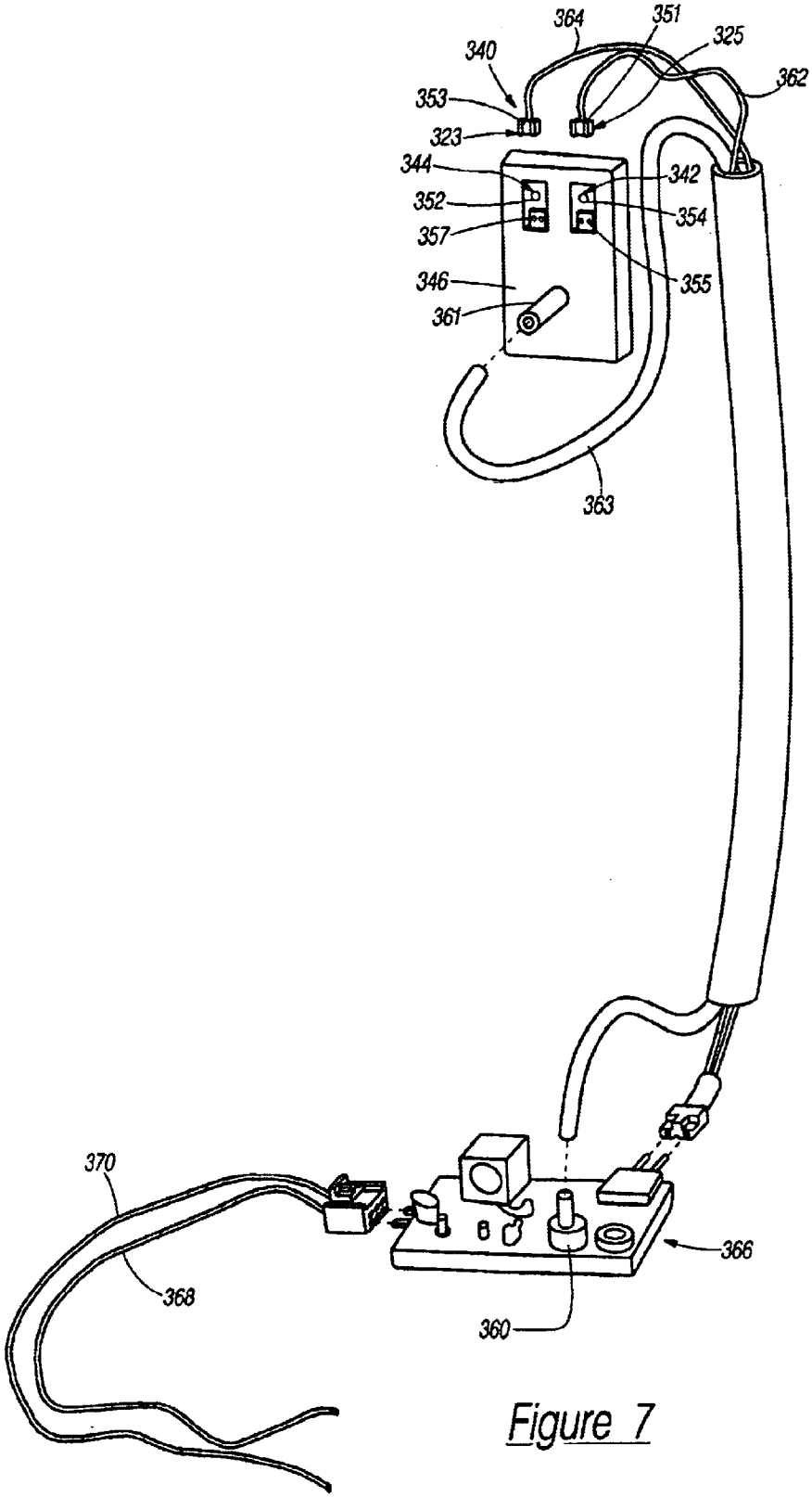
FIG. 7 is a diagrammatic illustration of the conductive sensor and pressure sensor according to the embodiment of FIG. 6.

Still another embodiment of the invention is depicted in FIGS. 6, 7, 7A, 7B, 8, and 13. As shown in FIG. 6, this embodiment includes another sensor 29 and indicating device 45 for detecting and indicating when the recovery tank 26 is full. The second sensor 29 is located on the suction duct 24 between the suction nozzle 16 and the recovery tank 26. In this embodiment, the sensor 29 is a pressure sensor. As depicted in FIG. 7, a pressure port or nipple 361 is integrally formed with a mounting plate 346 generally in the center. A suction tube 363 is connected between the pressure port 361 and a pressure switch 360 mounted to a printed circuit board 366. The mounting plate 346 is mounted to the suction duct 24 in any suitable manner such as, for example, using mounting screws. When the mounting plate 346 is mounted to the suction duct 24, the pressure port 361 is in fluid communication with the interior of the suction duct 24.

In this embodiment, the moisture sensor 28 (FIG. 6) is a conductive sensor 340, as shown in FIG. 7, comprising a pair of electrodes 342, 344 that are mounted to the internal surface of the suction duct 24 (FIG. 6). Moisture traveling through the suction duct is propelled against the inner surface of the duct and bridges the gap between the electrodes 342 and 344. Due to the conductivity of the moisture, electricity flows between the electrodes; and the alarm activating circuit (also referred to herein as an "indicator activating circuit") turns the green lamp 36 (FIG. 6) off and turns the amber lamp 38 (FIG. 6) on. The mounting arrangement for the electrodes 342, 344 will now be described in more detail. Male terminal portions 355, 357 from spade type contacts 325, 323 are secured to the mounting plate 346. The electrodes 342, 344 in the form of rivets 354, 352 extend through their respective male terminal portions 355, 357 into the suction duct 24 (FIG. 6) and are flanged back onto the internal surface of the suction duct 24 (FIG. 6) so that they are secured to the mounting plate 346. Female portions 351, 353 of the contacts 325, 323 are frictionally fitted over their respective male terminal portions 355, 357. The electrodes 342, 344 are electrically connected to a printed circuit board 366 by leads 362 and 364, which are attached to the female portions 351, 353 of the contacts 325, 323. The leads 362, 364 plug into the printed circuit board 366.

Figure 7A:
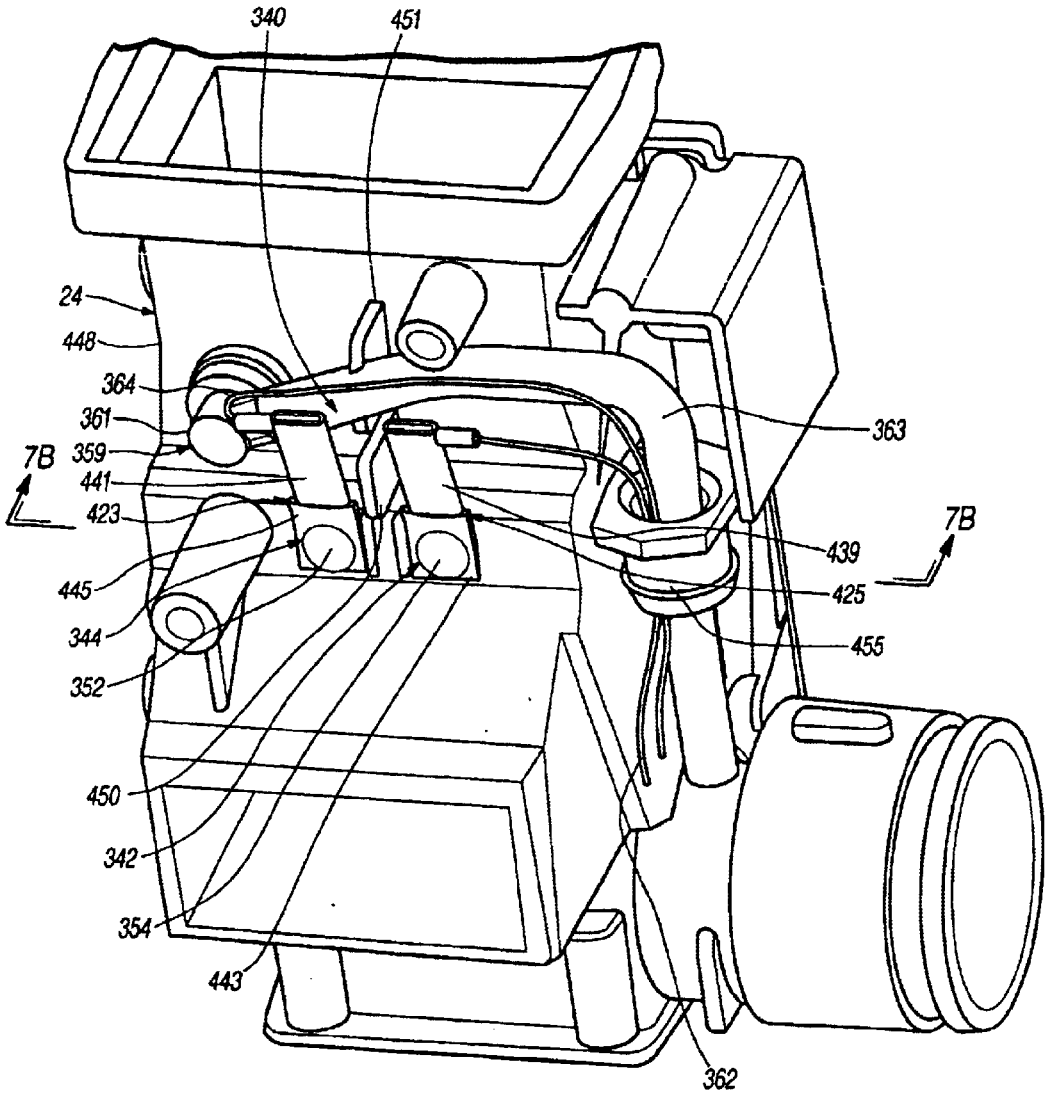
FIG. 7A is a front perspective view of a valve body of a suction duct shown in FIG. 6 showing an alternative version and arrangement of the two sensors depicted in FIG. 7.
Figure 7B:
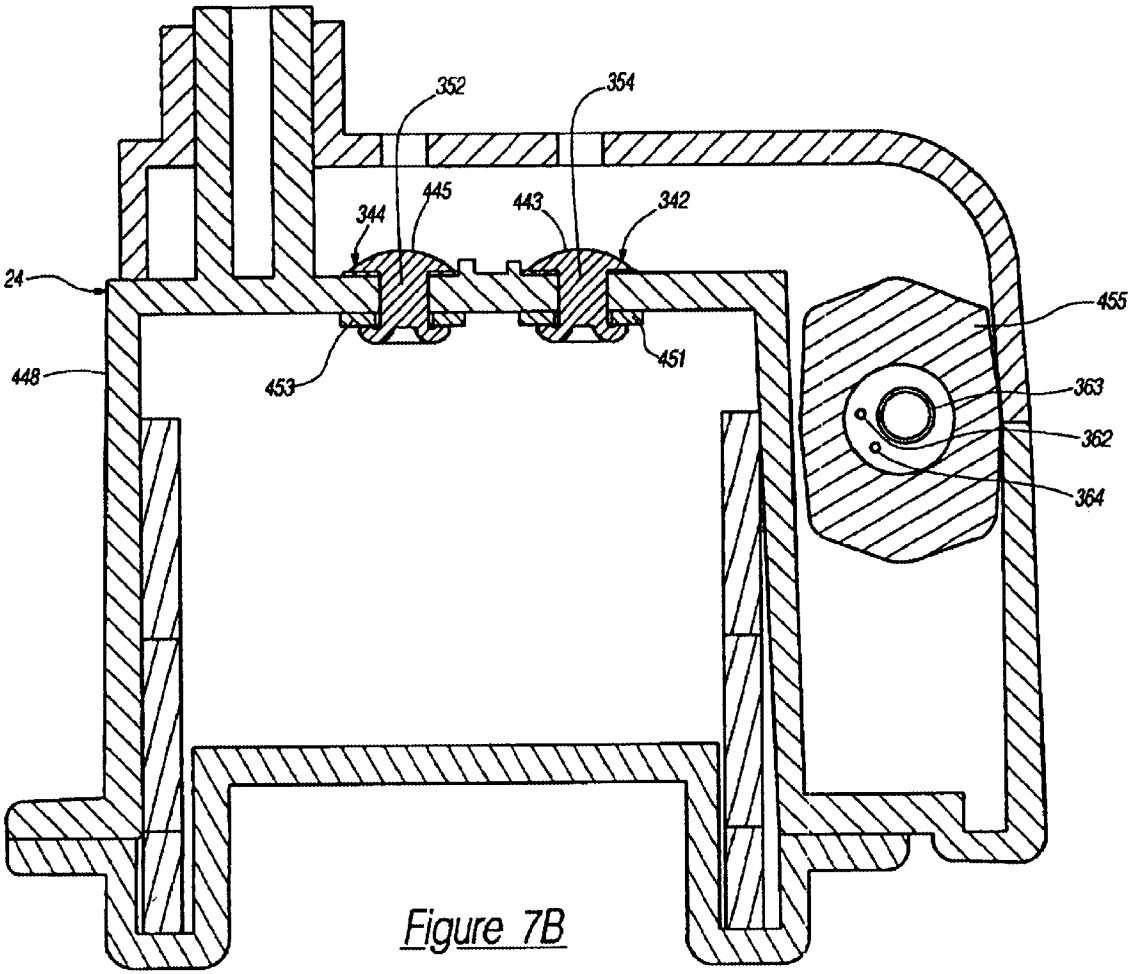
FIG. 7B is a sectional view taken along line 7B—7B of FIG. 7A.

Alternatively, the mounting plate may be removed and the conductive sensor 340 and the pressure sensor 359 may be directly mounted to the suction duct 24. One such arrangement is shown in FIGS. 7A and 7B. In this arrangement for the pressure sensor 359, the suction port 361 with the suction tube 363 connected to it is attached to a valve housing 448 of the suction duct 24 as depicted in FIG. 7A. For the conductive sensor 340 depicted in FIG. 7A, male terminal portions 443, 445 of flag type contacts 423, 425 are secured or position to the front of the valve housing 448. The electrodes 342, 344 in the form of the rivets 354, 352 are inserted into apertures of the male terminal portions 443, 445. As seen in FIG. 7B, the rivets 354, 352 extend into the interior of the valve housing 448 of suction duct 24 and are flanged back onto respective washers 451, 453 so that the electrodes 342, 344 are secured to the valve housing 448. Flag shaped female portions 439, 441 (FIG. 7A) of the contacts 423, 425 are frictionally fitted onto their respective male terminal portions 443, 445. The leads 364, 362 are attached to their respective female portions 439, 441 of the contacts 423, 425, so that the electrodes 342, 344 are electrically connected to a printed circuit board 366 (FIG. 7). A U-shaped holder 451 receives the lead 364 and suction tube 363, and a tube holder 455 receives the leads 364, 362 and suction tube 363 to keep them secure. A rib 450, integrally formed on the front of the valve housing 448, is located between the electrodes 344 and 342 to prevent them from contacting each other.

The general function of the pressure sensor 359 will now be described. Referring to FIG. 6, the motor fan assembly 18 draws air in through the suction nozzle 16 for extracting the soiled cleaning liquid from the carpet. The soiled cleaning liquid travels through a suction duct 24 and into a recovery tank 26 where the liquid-laden substance is separated from the air and collected in a recovery tank 26. The substantially dry air, as indicated by the dashed arrows, is drawn into the motor-fan assembly 18 and exhausted to the atmosphere, as indicated by arrow 23 of FIG. 6, thereby creating a vacuum in the suction duct 24 resulting in a pressure in the range of −15 inches to −35 inches of water. A wall or barrier 33 directs the soiled cleaning liquid and then the dry air after the separation to travel through a float cage 31 attached to the underside of the lid 35 of the recovery tank 26. The float cage 31 contains a float 27 which operates in conjunction with the pressure sensor 359 as follows. When the liquid in the recovery tank 26 reaches a full level, the float 27 rises to a position as indicated by the phantom lines to choke or block the flow of working air from exhausting to the atmosphere. This action increases the pressure in the duct 24 near the suction port 361 to approximately zero inches of water, which is detected by the pressure switch 360.

The output of the pressure switch 360 (FIG. 7) is inputted to the microprocessor 162 (FIG. 8) of the printed circuit board 366 (FIG. 7). A 120 volt source from a typical household outlet (not shown) supplies power to the board 366 via leads 368, 370 (FIG. 7), which are plugged into the board. When the pressure switch 360 detects the increase in pressure of the suction duct 24 caused by the float 27 blocking the air, the switch 360 causes the microprocessor 162 to turn on the red LED 45 (FIG. 6) to indicate that the recovery tank 26 is full.

It should be noted that the pressure sensor 359 in the form of a differential pressure switch could detect the change in pressure of the suction duct 24 resulting just from the liquid in the recovery tank 26 reaching a full level, if the float 27 was not used to choke to flow of working air to increase the pressure in the suction duct 24. Further, the microprocessor could also be programmed to turn off the motor fan assembly 18, when the liquid in the recovery tank 26 reaches a full level.

The microprocessor 162 provides the additional flexibility of flashing any of the lights to create a more visible indicator. In the present embodiment, the microprocessor 162 is programmed to flash the red "full tank" LED 45 on and off to visually alert the user of a full tank condition. The pressure or vacuum switch 360 and respective indicating circuit are substantially the same as the dirt detector for use in upright vacuum cleaners disclosed in U.S. Pat. No. 5,608,944 the disclosure of which is incorporated herein as a reference.

Figure 8:
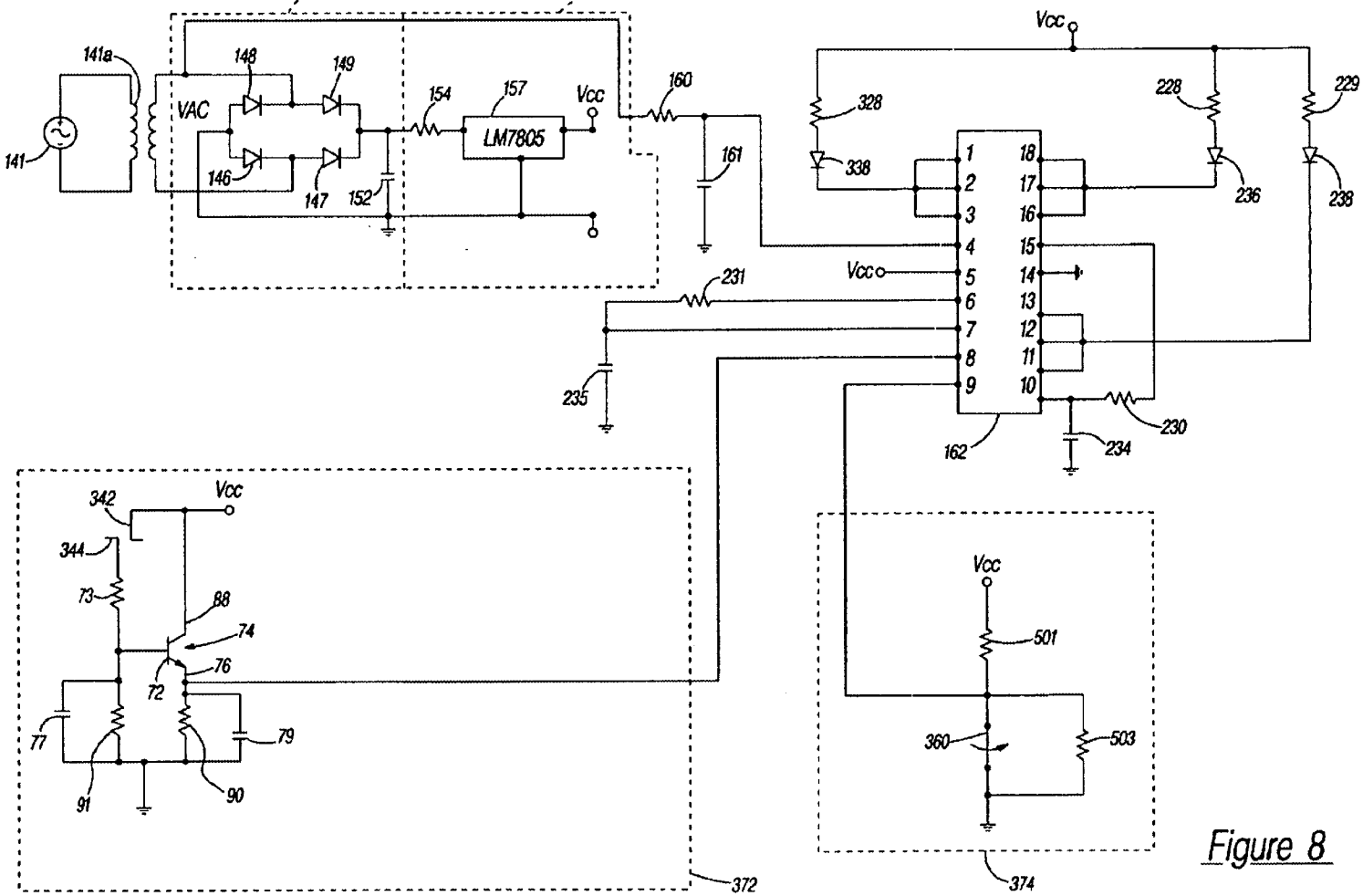
FIG. 8 is a block schematic diagram of an alarm actuating circuit for use in connection with the conductive sensor and pressure sensor of FIGS. 7 and 7A.

FIG. 8 shows the rectifying circuit 242 and regulator circuit 243 which is similar to that of FIG. 5, except that the alternating current 120 volt input voltage 141 is connected to an isolation transformer 141*a* and the avalanched diode 156 is replaced by a voltage regulator 157 (LM7805). Also, capacitors 145, 150, and resistor 144 have been removed. The alternating current power source 141*a* is coupled through resistor 160 to the microprocessor 162 for zero cross detection.

The detection circuit as shown in FIG. 8 comprises a microprocessor 162 (Z86E02); a moisture sensor section 372 associated with the conductive sensor 340 and the pressure detection circuit 374 associated with the pressure sensor 359. For the moisture sensor section 372, the electrodes 342 and 344 are spaced from one another on the internal surface of the duct 24. One electrode 344 is connected to the base 72 of the npn transistor 74 (commercially available as a Q2N3904) through a current limiting resistor 73. The emitter 76 of the transistor 74 is connected to a line input of the microprocessor 162. Smoothing capacitors 77 and 79 are connected across resistors 91 and 90, respectively. When the moisture bridges the gap between the electrodes 342, 344, a current flow is established in the base 72 of the transistor 74. The current flowing into the base 72 of the transistor 74 allows current to flow from the collector 88 of the transistor 74 to the emitter 76, thereby establishing a voltage across resistor 90. The voltage across resistor 90 is proportional to the conductivity across the gap between the electrodes 342 and 344. The conductivity across the electrodes is proportional to the quantity of liquid bridging the electrodes, which is proportional to the quantity of liquid traveling through the suction duct 24.

For the pressure detection circuit 374, the pressure switch 360 is normally closed and connected to ground, when the recovery tank is not at the full level. Thus, a zero voltage signal is transmitted to the microprocessor. When the pressure reaches a predetermined level indicative of a full tank, the pressure switch 360 will open and thus allow a signal of approximately 2.5 volts to be sent to the microprocessor 162 via a voltage divider created by resistors 501 and 503.

The outputs of the sensor section 372 and pressure detection circuit 374 are inputted into line inputs of the microprocessor 162. Diode elements and resistance 228, 229, 328, 230, 231 and capacitance 234, 235 are incorporated into line inputs in to the microprocessor 162. The visual indicator LED components 236, 238, and 338, connected between circuit voltage Vcc and microprocessor 162, are shown with diode 236 emitting a green color, diode 238 emitting an amber color, and diode 338 emitting a red color. The microprocessor 162 performs an analog to digital conversion on the outputs from the sensor section 372 and pressure detection circuit 374 and compares the analog data against threshold levels preprogrammed by the manufacturer.

With respect to the conductive sensor 340 (FIG. 7), at levels exceeding the preset threshold, indicating a wet carpet condition, the microprocessor 162, as depicted in FIG. 8, indicates to the user through the amber LED 238 that the moisture content of the carpet is high and that extraction should continue until the level falls below the preset threshold. At that point, microprocessor 162 switches back to activate the green LED 236, whereby indicating to the user that the carpet is sufficiently dry. Alternatively, the microprocessor 162 can be programmed to initially set an upper threshold value. Once the output signal from the conductive sensor reaches this value, the microprocessor 162 indicates to the user through the amber LED 238 that moisture is being extracted, and a lower threshold value is written in the program. The output signal from the conductive sensor must fall below this new value to indicate through the green LED 236 that the moisture is no longer being extracted or "dry" condition.

With respect to the pressure switch 360, at levels below the preset threshold, indicating that the liquid level in the recovery tank 26 is full, the microprocessor 162, as depicted in FIG. 8, indicates to the user through the flashing red LED 338 to remove and empty the liquid from the recovery tank 26.

Figure 9:
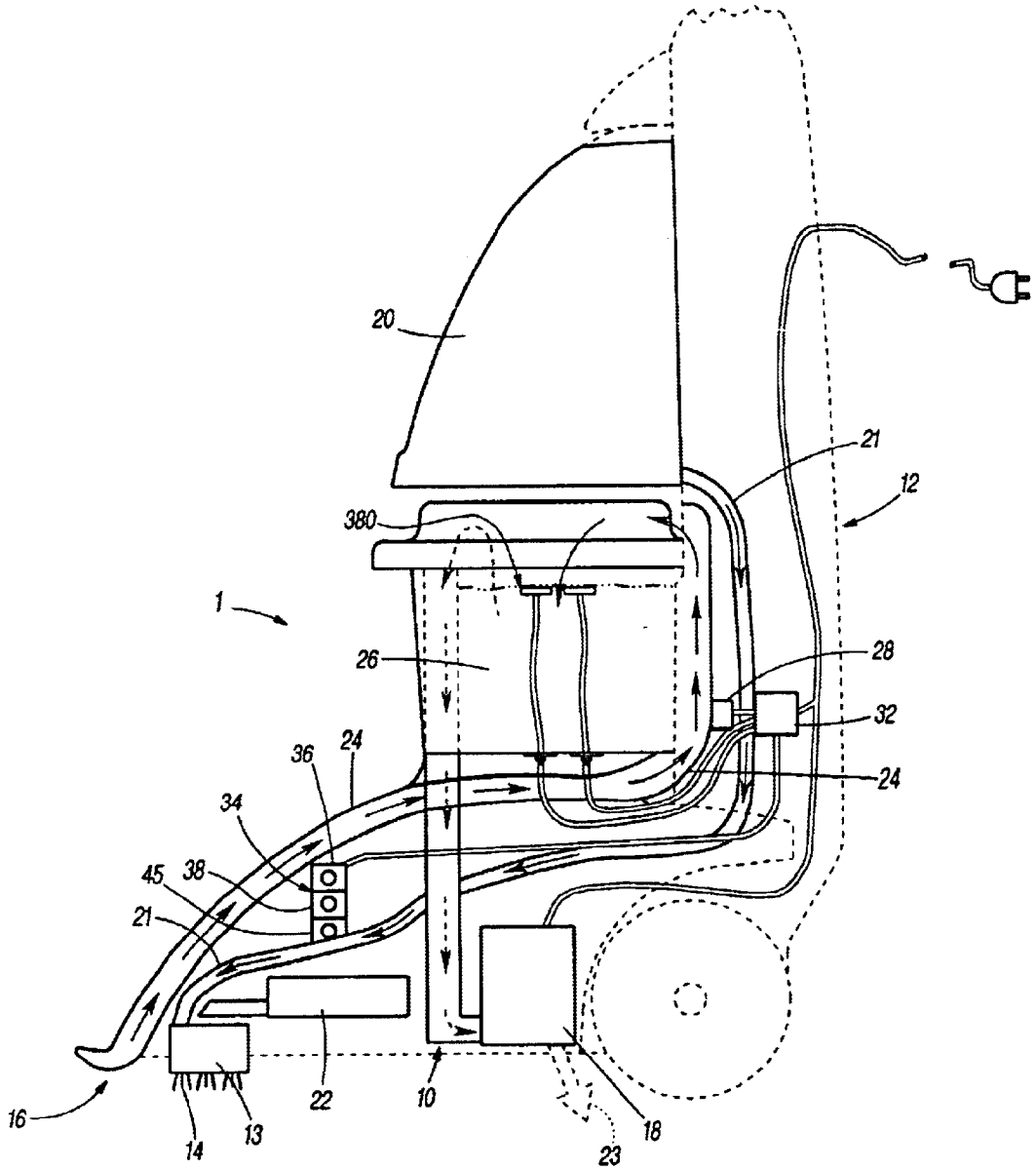
FIG. 9 is a diagrammatic illustration of an upright style wet extraction carpet cleaning appliance provided with two moisture sensors and indicators according to another the embodiment of the present invention.
Figure 10:
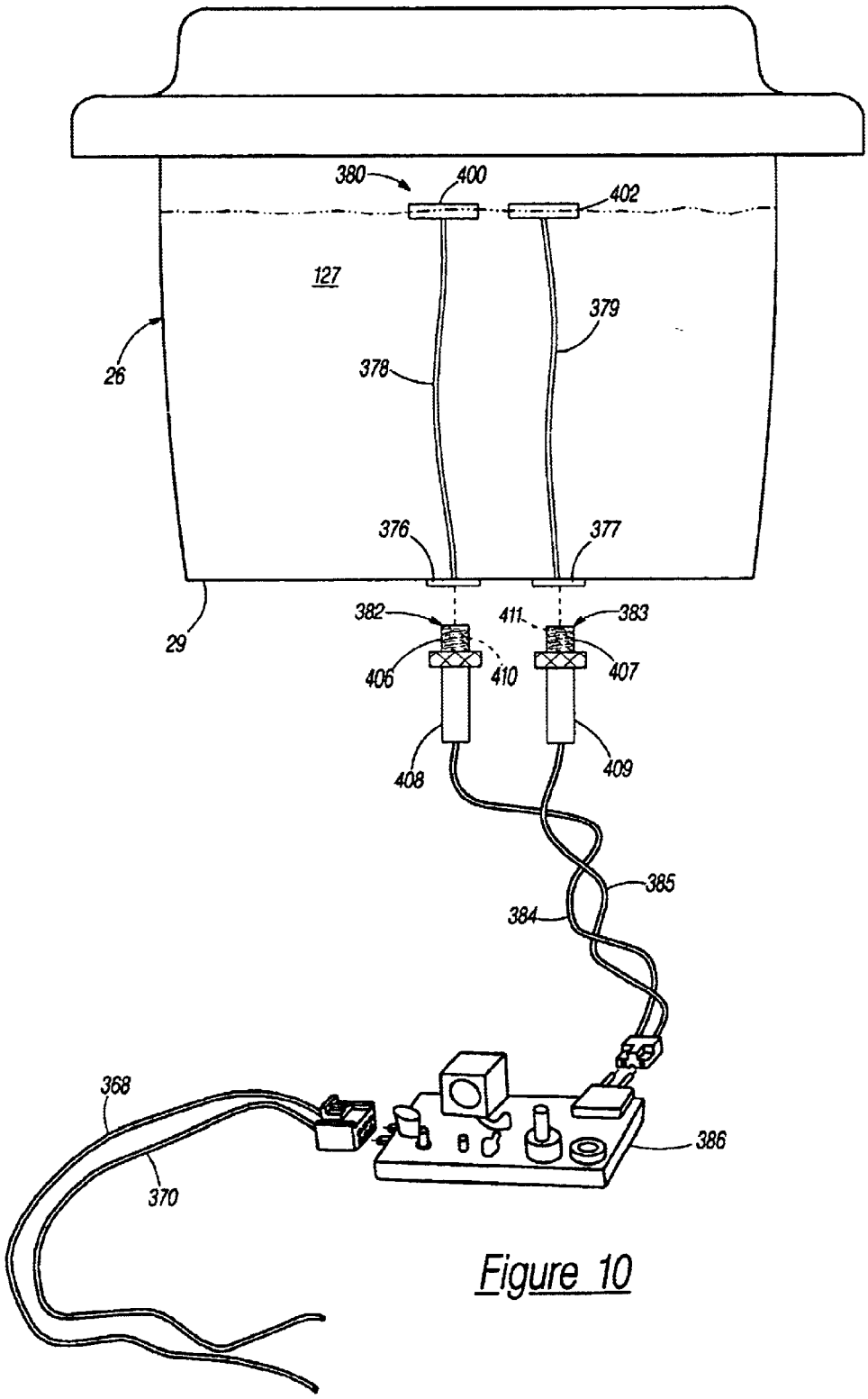
FIG. 10 is a diagrammatic illustration of the second conductive sensor mounted to a recovery tank according to the embodiment of FIG. 9.
Figure 11:
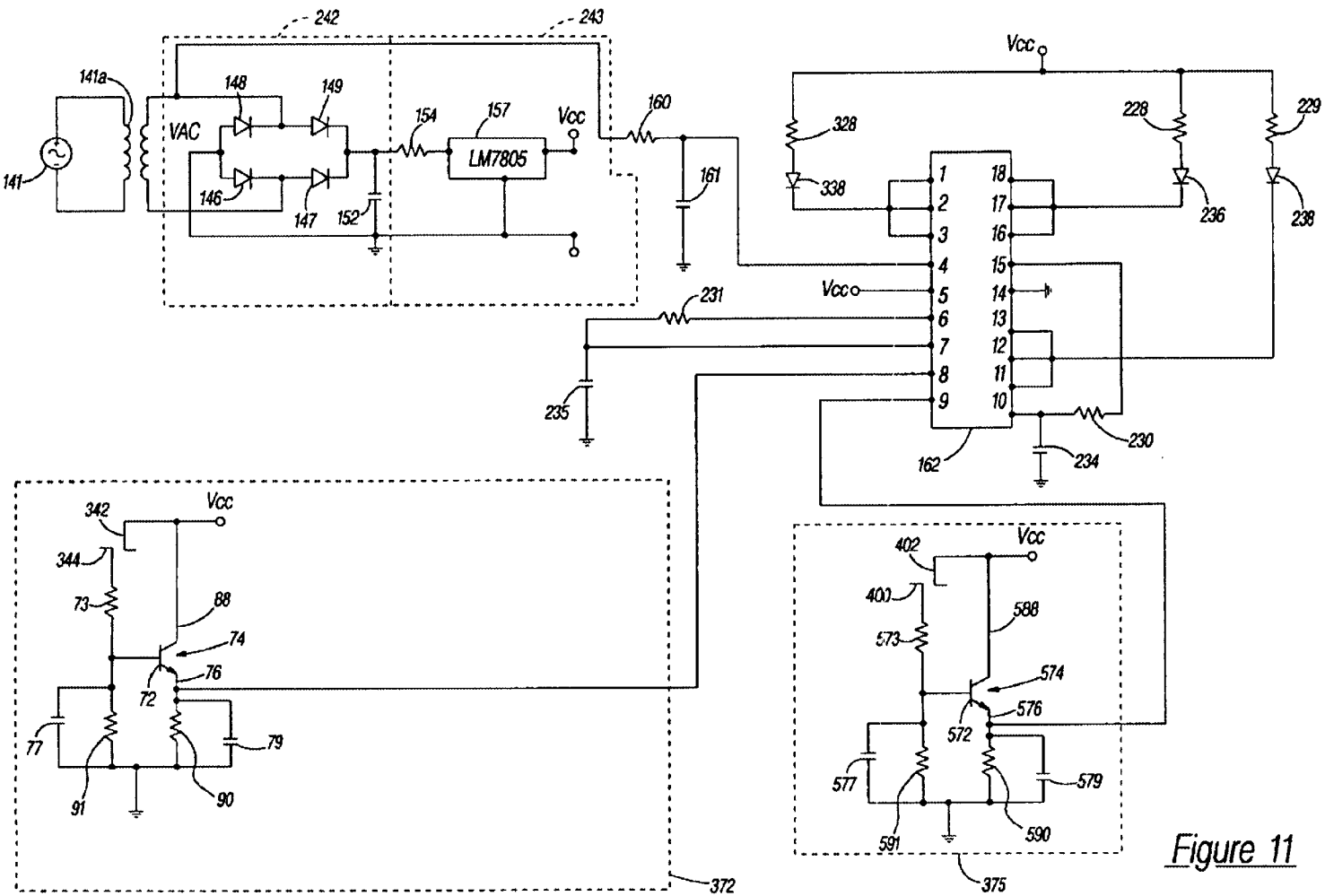
FIG. 11 is a block schematic diagram of an alarm actuating circuit for use in connection with the two conductive sensors of FIG. 10.

In another embodiment of the invention as shown in FIGS. 9 through 11, a second conductive sensor 380 is used. As shown in FIG. 10, the sensor 380 is mounted to a side wall 127 of the recovery tank 26. A first pair of contacts 376, 377 is mounted to the bottom wall 29 of the recovery tank 26 and is connected by their respective leads 378, 379 to the electrodes 400 and 402 of the sensor 380. A second pair of contacts 382, 383 is mounted to the duct 24 (FIG. 9) and connected by their respective leads 384, 385 to the printed circuit board 386. The second pair of contacts 382, 383 is spring loaded, having respective inner portions 406, 407 telescopically connected to outer portions 408, 409 by springs 410, 411. Alternatively, a leaf spring type contact could also be used.

When the recovery tank 26 is mounted to the base frame or floor engaging portion 10, the first and second pairs of contacts 376, 377 and 382, 383, respectively, are in abutting contact with each other creating an electrical connection between them. When the recovery tank 26 is removed from the floor engaging portion 10, the electrical connection is broken between the first pair of contacts 376, 377 and second pair of contacts 382, 383 since they do not contact each other. This abutting arrangement between the first and second pairs of contacts allows the tank 26 to be easily removed from the floor engaging portion 12 for emptying the liquid therein and then mounted back to the floor engaging portion 12 to electrically connect the electrodes 400, 402 to the printed circuit board 386.

The indicator actuating circuit as shown in FIG. 11 is similar to that of FIG. 8 except that the sensor section 375 for the second conductive sensor 380 replaces the pressure detection circuit 374. This sensor section 375 is similar to that for sensor section 372 as previously described. In particular, one electrode 400 is connected to the base 572 of the npn transistor 574 (commercially available as a Q2N3904) through a current limiting resistor 573. The emitter 576 of the transistor 574 is connected to a line input of the microprocessor 162. Smoothing capacitors 577 and 579 are connected across resistors 591 and 590, respectively. When the moisture bridges the gap between the electrodes 400, 402, a current flow is established in the base 572 of the transistor 574. The current flowing into the base 572 of the transistor 574 allows current to flow from the collector 588 of the transistor 574 to the emitter 576, thereby establishing a voltage across resistor 590. The voltage across resistor 590 is proportional to the conductivity across the gap between the electrodes 400 and 402.

The microprocessor 162 would also be reprogrammed with similar threshold values as the first conductive sensor 340. Thus, when the liquid in the tank 26 reaches a level to bridge the gap between the electrodes 400, 402 and causing current to flow to the microprocessor 162, the microprocessor 162 will operate similar to that for the first conductive sensor 340. In particular, the microprocessor 162 will generate a control signal, compare it to a preset threshold, and activate the red LED 338 if the control signal reaches the preset threshold.

Figure 12:
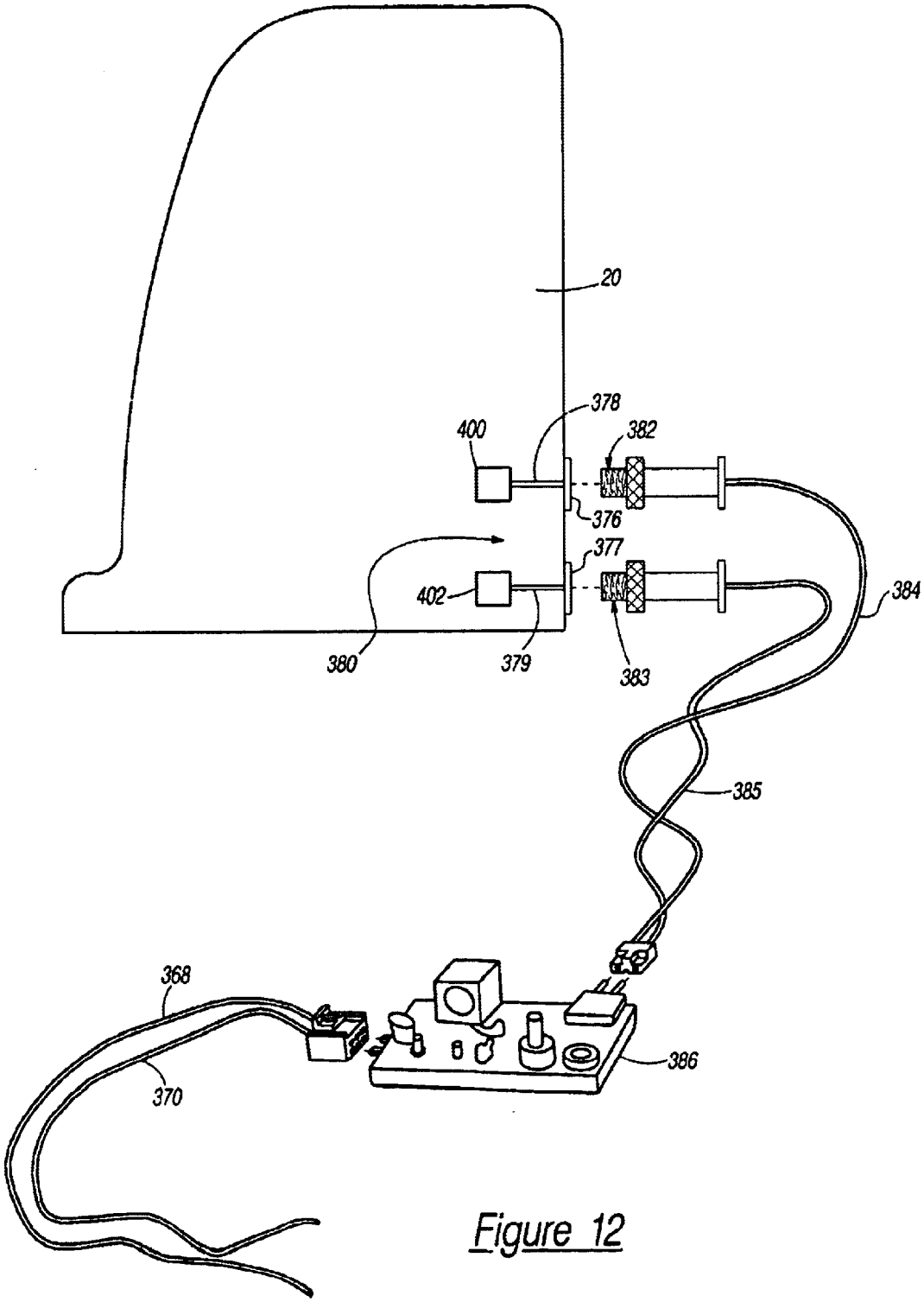
FIG. 12 is a diagrammatic illustration of the second conductive sensor being mounted to a supply tank.

In another embodiment depicted in FIG. 12, the second conductive sensor 380 can be mounted to the solution tank 20 to detect the solution level. In this embodiment, the electrodes 400, 402 are mounted near the bottom of the solution tank 20 and the microprocessor 162 is programmed to activate the red LED 338 when the liquid level does not bridge the gap between the electrodes, 400, 402, which is indicative of the solution tank 20 being nearly empty. Alternatively, this conductive sensor 380 with its respective indicating device can be used for the solution tank 20 in addition to the other two conductive sensors depicted in the embodiments of FIGS. 9 through 11.

Figure 13:
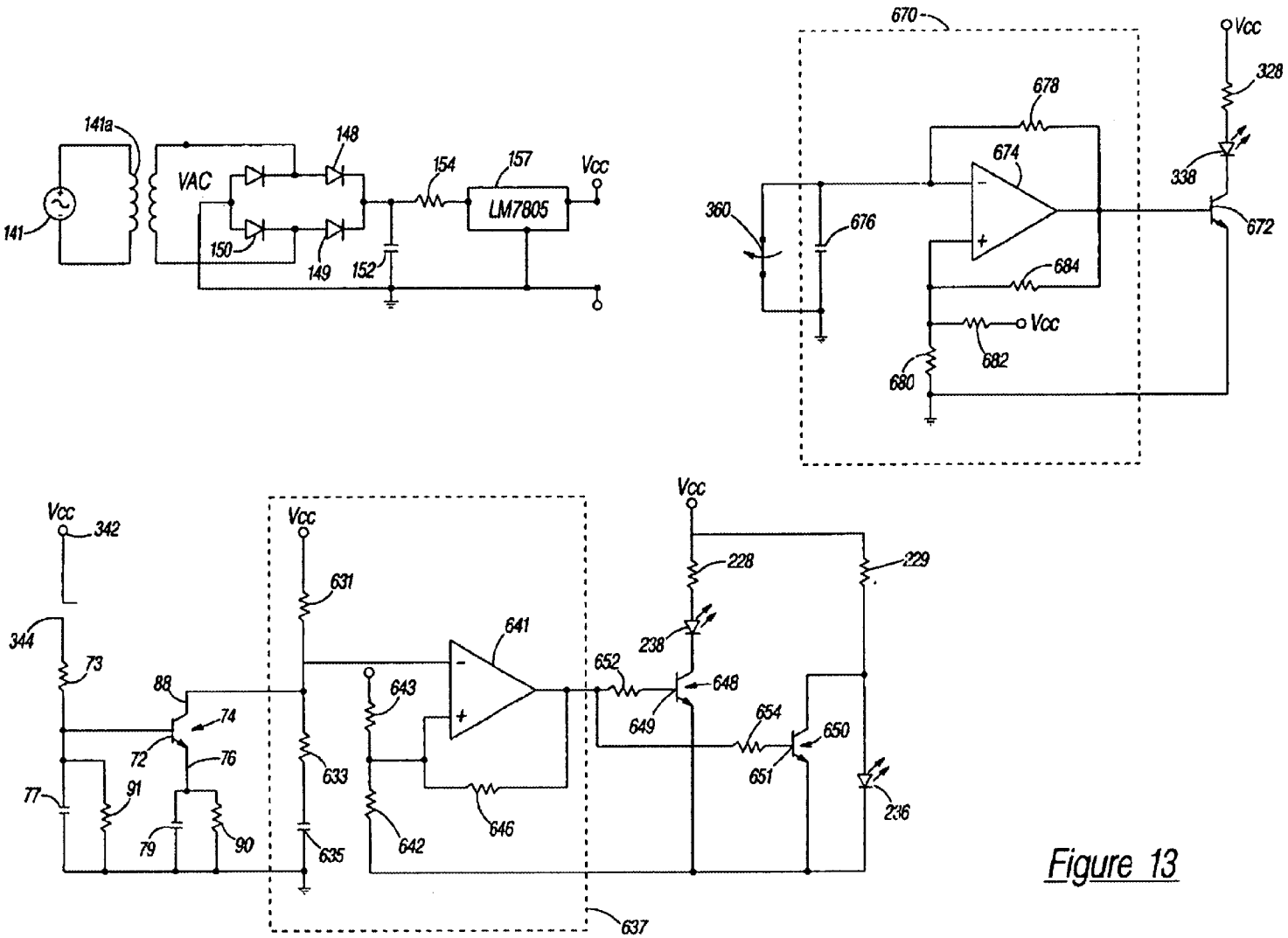
FIG. 13 is a block schematic diagram of an alternative embodiment of the alarm actuating circuit for use in connection with the conductive sensor and pressure sensor of FIGS. 7 and 7A.

In another embodiment, as shown in FIG. 13, an analog circuitry replaces the microprocessor used for the pressure switch 360 and moisture sensor section 372 depicted in FIG. 8. For the moisture sensor section 372 of this embodiment, the collector 88 of transistor 74 is no longer connected to Vcc, but between resistors 631 and 633. These resistors 631, 633 in combination with capacitor 635 form a timing circuit that determines the amount of time the ambered LED 238 stays on.

The operational amplifier configuration including the timing circuit in the conductive sensor is known as an inverting comparator with hysteresis circuit 637. In particular, the collector 88 from the transistor 74 is connected to the inverting input of the comparator 641. This output voltage from the conductive circuit will be compared with a reference voltage at the non-inverting input of the comparator 641. This reference voltage is formed by voltage Vcc being divided by resistors 643 and 644. A resistor 646 provides hysterisis to the comparator circuit 637. The output of the comparator 641 is inputted into the base 649 of switching transistor 648 through resistor 652 for the amber LED 238, and also inputted into the base 651 of the switching transistor 650 through resistor 654 for the green LED 236. The resistors 652 and 654 block any leakage current to the comparator 641. The resistors 228 and 229 are used to limit current to the amber and green LEDs 238 and 236, respectively.

In operation, when the moisture bridges the gap between the electrodes 342, 344, a current flow is established in the base 72 of the transistor 74. The current flowing into the base 72 of the transistor 74 allows current to flow from the collector 88 of the transistor 74 to the emitter 76, thereby causing capacitor 635 to discharge through resistor 633 and transistor 74. This causes voltage at the inverting input to be approximately zero. The comparison of this voltage and the reference voltage causes the output of the comparator to be high, thereby transmitting a control signal to switching transistor 648. The control signal turns switching transistor 648 on which causes amber LED 238 to conduct. Also, the control signal from the output of the comparator causes switching transistor 650 to turn on. However, this action does not turn the green LED 236 on too, since the switching transistor 650 shorts the green LED 236. The green LED 236 being shorted prohibits current to flow through it, and therefore it is turned off.

When the moisture no longer bridges the gap between the electrodes 342 and 344, the transistor 74 is turned off and the capacitor 635 begins to charge through resistors 633 and 631 until the voltage at the inverting input of the comparator 641 becomes greater than that at its non inverting input. When this occurs, the output at the comparator 641 is low, turning off switching transistors 648 and 650. The amber LED 238 no longer conducts, since the turning off of the switching transistor 648 creates an open circuit condition across the transistor such that no current can flow through the amber LED 238. However, the green LED 236 conducts, since the switching transistor 650 is in an open circuit condition, thereby allowing current to flow through the green LED 236. Also, resistors 631, 633 and capacitor 635, which comprise the timing circuit, prevent the amber LED 238 from flickering due to voltage spikes or other irregularities. Additionally, the amount of time that it takes for capacitor 635 to charge back up through resistors 631 and 633 from Vcc, when transistor 74 is off, controls the amount of time that it will take before the amber LED 238 turns off and the green LED 236 to turn back on.

For the pressure switch 360 of the full tank indicator circuit, an oscillator circuit 670 is connected between a switching transistor 672 and the pressure switch 360. The oscillator circuit 670 includes a capacitor 676 and a resistor 678 which form a timing circuit, a comparator 674, and resistors 680, 682, and 684 which form a voltage dividing network for reducing voltage Vcc to a suitable reference voltage that is inputted into the non inverting input of comparator 674. The pressure switch 360, which is normally closed (when the recovery tank is not at full level), shorts the capacitor 676. Thus, no voltage signal is transmitted to the oscillator circuit 670. However, when the pressure reaches a predetermined level indicative of a full tank (approximately −5"), the switch 360 will open and transmit a voltage signal to the oscillator circuit to enable it. The control signal from the output of the oscillator circuit 670 turns the switching transistor 672 on and off thereby causing the red LED 338 to turn on and off or flash. The timing circuit formed by capacitor 676 and resistor 678 will set a value for the rate of flashing for the red LED 338.

Figure 14:
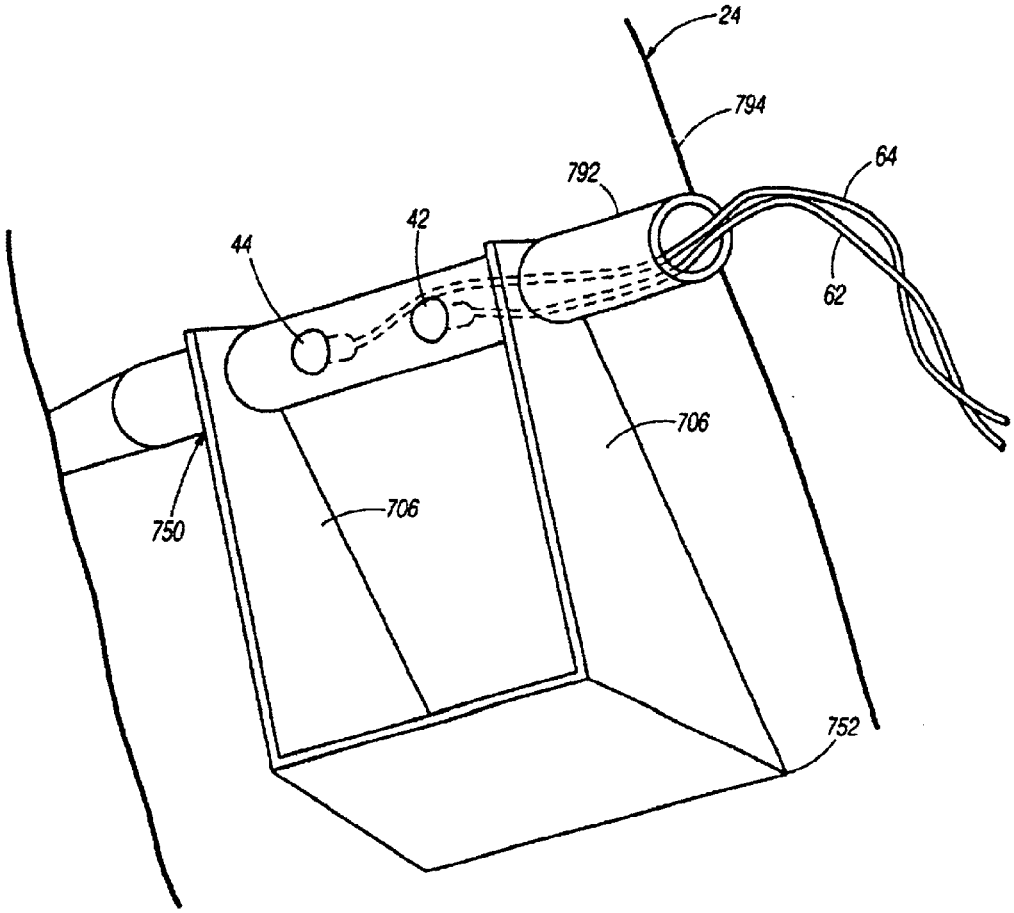
FIG. 14 is a perspective view of a suction control valve mounted to a valve housing portion of a suction duct with portions of the valve housing cut away for illustrative purposes.

Still, another location to mount the moisture sensor 28 is depicted in FIG. 14. In particular, the electrodes 42, 44 from the conductive sensor 40 (FIG. 2) are mounted to the rotatable hollow shaft 792 of the main suction control valve 750. The leads 62, 64 of the electrodes 42, 44 pass through the interior of the shaft 792 and are electrically connected to the printed circuit board 60 (FIG. 2). The main suction control valve 750 preferably comprises a valve member 752 that is mounted to the rotatable shaft 792 by webs 706 for pivotal motion in the valve housing 794 about an axis defined by the rotatable shaft 792. Generally, the rotatable shaft 792 of the main suction control valve 750 is mounted to a main valve housing 794 of the suction duct 24 identical to that disclosed in previously mentioned U.S. Pat. No. 5,983,442, which is incorporated herein by reference. It has been found that the moisture sensor 28 being mounted to the rotatable shaft 792 eliminates false control signals, which incorrectly represent conductivity between the electrodes 42, 44 from being transmitted to the printed circuit board 60.

Figure 15:
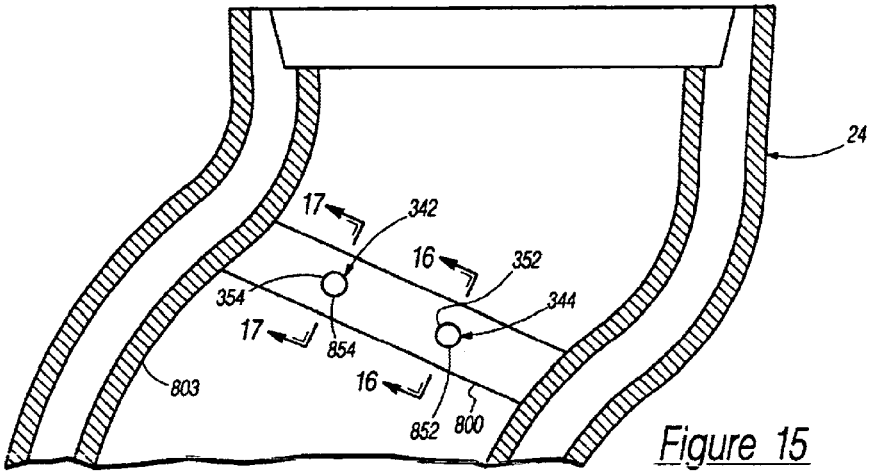
FIG. 15 is a partial sectional view of the suction duct according to another embodiment of the invention.
Figure 16:
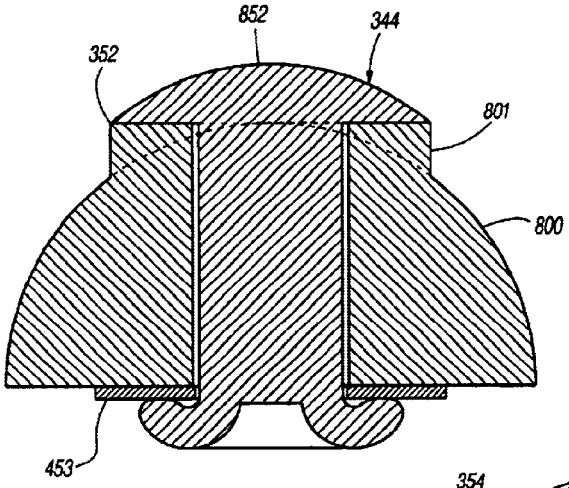
FIG. 16 is a sectional view taken along line 16—16 of FIG. 15.
Figure 17:
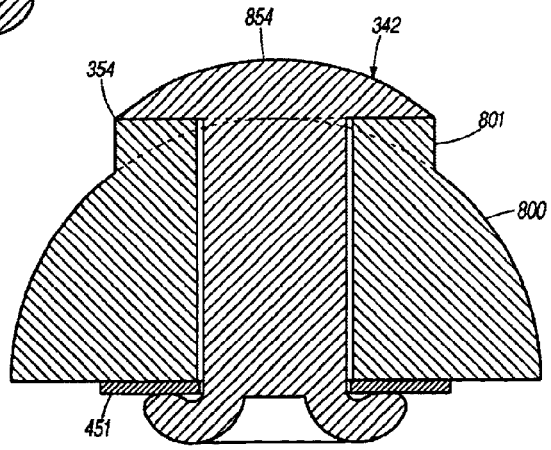
FIG. 17 is a sectional view taken along line 17—17 of FIG. 15.

In another embodiment of the invention as shown in FIGS. 15, 16 and 17, the electrodes 342, 344 in the form of rivets 354, 352 are mounted to a rib 800 that extends across the interior of the suction duct 24 (FIG. 15). Preferably, the rib 800 is attached to the narrowest portion of the suction duct 24, so that a higher volume of water passes directly over the electrodes. The electrodes 342, 344 are spaced at one half an inch apart, and are placed along the length of the rib 800 near the wall 803 of the suction duct 24 located at the outer radius of a curve in the suction duct 24. As seen in FIGS. 16 and 17, the rib 800 is semi-cylindrical in cross section with vertical cylindrical protrusions 801 integrally formed with the ledge 800 for supporting the rivets 352 (FIG. 16), 354 (FIG. 17). The heads 852 (FIG. 16), 854 (FIG. 17) of the rivets are mounted flush upon the protrusions and thus are secured to the ledge 800.

It will further be appreciated that modifications to the alarm activating circuit and indication devices activated thereby can be made. Other indicators may be employed. For example, an audible indicator in the form of a buzzer, or some other type of visual indicator such as an air driven or electrically driven rotating disk or mechanical flag that moves into or out of an indicating position may be employed. Whatever indicator is chosen, it will serve to notify the user of the appliance in a readily discernible manner whether the carpet or floor surface is in a relatively wet condition or in a sufficiently dry condition and/or whether the liquid in the recovery or solution tank is at a predetermined level.

In an additional embodiment of the invention, microprocessor 162 may be operatively connected to motor-fan assembly 18 for controlling the speed at which the motor-fan assembly operates. In such an embodiment, varying thresholds of wetness may be programmed into the microprocessor whereby the microprocessor increases or decreases the speed of the motor-fan assembly based on the wetness detected by the sensor. The microprocessor will increase the speed of the motor-fan assembly, thus increasing the suction and air flow through suction nozzle 16, when damper or wetter areas of the carpet are encountered. Likewise, the microprocessor will decrease the speed of the motor-fan assembly, thus decreasing the suction and air flow through suction nozzle 16 when less damp or wet areas of the carpet are encountered. In addition, the microprocessor 162 may be programmed to increase or decrease the speed of the motor-fan assembly based on the liquid in the recovery or solution tank reaching a predetermined level.

Although the present moisture indicator is shown and described for use with wet pickup or extraction type of cleaners, it is understood that the moisture indicator can be used on dry pickup vacuum cleaners as well. When incorporated into a dry vacuum cleaner, the moisture indicator of the present invention functions as a safety device to shut-off the motor-fan assembly. The sensor is located within a dirt conveying duct of the dry vacuum cleaner for detecting the presence of a liquid, as described above and shown in FIGS. 2 and 3. When a liquid contacts and completes the circuit between electrodes 42 and 43 a corresponding control circuit will disable or trip the line voltage via a relay or other semiconductor device, such as a triac, SCR or the like, electrically connected between the line voltage and the motor-fan assembly. Disabling power to the motor-fan assembly upon the detection of moisture in the duct, will shut down the motor-fan assembly thus preventing a potentially hazardous condition. Further, power can be disabled to the motor-fan assembly upon detection of a full or other predetermined liquid level of the recovery 26 or solution tank 20. It should also be noted that a pressure transducer could also be used instead of the pressure switch 360.

While embodiments of the invention have been shown and described herein, it should be readily apparent to persons skilled in the art that numerous modifications may be made therein without departing from the true spirit and scope of the invention. Accordingly, it is intended by he appended claims to cover all modifications which come within the spirit and scope of this invention.

What is claimed is:

1. A detecting system for a suction cleaner comprising:

a first sensor mounted to the cleaner and positioned to detect the moisture level of a cleaning surface;

a circuit electrically connected to the first sensor for generating a first control signal in response to the detected moisture level of the cleaning surface;

a tank removably mounted to said suction cleaner for containing liquid;

a second sensor mounted to the cleaner to detect when the liquid of said tank reaches a predetermined level, said second sensor being a pressure switch responsive to a pressure level associated with said predetermined liquid level in said tank;

wherein said circuit is electrically connected to the second sensor for generating a second control signal in response to the detected liquid level of said tank; and a device responsive to said second control signal for indicating when the liquid of said tank reaches a predetermined level.

2. The detecting system of claim 1, wherein said device comprises at least one lamp which is illuminated by the circuit when the liquid of said tank reaches a predetermined level.

3. The detecting system of claim 2, wherein the circuit includes a microprocessor for comparing the first control signal to a threshold value.

4. A detecting system for a suction cleaner, said suction cleaner having a recovery tank for holding extracted liquid, said detecting system comprising;

a sensor operatively connected to said recovery tank to detect when the liquid of said recovery tank reaches a predetermined level, said sensor including a pressure switch responsive to a pressure level associated with said predetermined liquid level in said recovery tank;

a circuit electrically connected to said sensor for generating a control signal in response to said pressure level of said recovery tank; and a device responsive to said control signal for indicating when the liquid of said tank reaches a predetermined level.

5. The detecting system of claim 4, wherein said device comprises at least one lamp which is illuminated by the circuit when the liquid of said tank reaches a predetermined level.

6. The detecting system of claim 5, wherein the circuit includes a microprocessor for outputting said control signal.

7. The detecting system of claim 5, wherein said suction cleaner includes a base for movement along a surface, a handle pivotally connected to said base, said recovery tank being removable mounted to one of said base and said handle.

8. The detecting system of claim 7, wherein said suction cleaner includes a solution tank for holding cleaning solution, a distributor fluidly connected to said solution tank for distributing the cleaning solution on the surface.

9. A detecting system for a suction cleaner, said suction cleaner having a recovery tank for holding extracted liquid, said detecting system comprising;

a sensor operatively connected to said recovery tank to detect when the liquid of said recovery tank reaches a predetermined level, said sensor including a pressure switch responsive to a pressure level associated with said predetermined liquid level in said recovery tank;

a circuit electrically connected to said sensor for generating a control signal in response to said pressure level of said recovery tank; and wherein said circuit includes a microprocessor for outputting said control signal.

10. The detecting system of claim 9, wherein said suction cleaner includes a base for movement along a surface, a handle pivotally connected to said base, said recovery tank being removably mounted to one of said base and said handle, said suction cleaner includes a solution tank for holding cleaning solution, a distributor fluidly connected to said solution tank for distributing the cleaning solution on the surface.

11. A detecting system for a suction cleaner, said suction cleaner having a recovery tank for holding extracted liquid, said detecting system comprising;

a first sensor operatively connected to said recovery tank to detect when the liquid of said recovery tank reaches a predetermined level, said sensor including a pressure switch responsive to a pressure level associated with said predetermined liquid level in said recovery tank;

a circuit electrically connected to said first sensor for generating a first control signal in response to said pressure level of said recovery tank;

a suction conduit assembly in fluid communication with said recovery tank for transporting said cleaning solution and dirt into said recovery tank; and wherein said first sensor is mounted to said suction conduit assembly.

12. The detecting system of claim 11 wherein said suction conduit assembly comprises a suction nozzle and a suction duct, said suction duct being fluidly connected between said recovery tank and said suction nozzle, said first sensor being mounted to said suction duct.

13. The detecting system of claim 11, wherein said suction cleaner includes a base for movement along a surface, a handle pivotally connected to said base, said recovery tank being removable mounted to one of said base and said handle.

14. The detecting system of claim 13, wherein said suction cleaner includes a solution tank for holding cleaning solution, a distributor fluidly connected to said solution tank for distributing the cleaning solution on the surface.

15. The detecting system of claim 11 including a suction tube fluidly connected between said first sensor and said solution conduit assembly.

16. The detecting device of claim 11 including a device responsive to said control signal for indicating when the liquid of said tank reaches a predetermined level.

17. The detecting system of claim 11 including a second sensor mounted to the cleaner and positioned to detect the moisture level of a cleaning surface.

18. The detecting system of claim 17 wherein said suction conduit assembly comprises a suction nozzle and a suction duct, said suction duct being fluidly connected between said recovery tank and said suction nozzle, said first sensor and second sensor being mounted to said suction duct.

19. A detecting system for a suction cleaner, said suction cleaner having a recovery tank for holding extracted liquid, said detecting system comprising;

a sensor operatively connected to said recovery tank to detect when the liquid of said recovery tank reaches a predetermined level, said sensor including a pressure switch responsive to a pressure level associated with said predetermined liquid level in said recovery tank;

a circuit electrically connected to said sensor for generating a control signal in response to said pressure level of said recovery tank; and a switching transistor being operatively connected to said lamp and said circuit, wherein said circuit outputs said control signal to turn on said switching transistor which causes said lamp to illuminate.

20. The detecting system of claim 19 wherein said circuit includes a comparator circuit section for outputting said second control signal, said comparator circuit section being operatively connected to said switching transistor.

21. The detecting system of claim 19 wherein said suction cleaner includes a base for movement along a surface, a handle pivotally connect to said base, said recovery tank being removably mounted to one of said base and said handle, said suction cleaner further including a solution tank for holding cleaning solution, a distributor fluidly connected to said solution tank for distributing cleaning solution on the surface.

22. A detecting system for a suction cleaner, said suction cleaner having a recovery tank for holding extracted liquid, said detecting system comprising;

a sensor operatively connected to said recovery tank to detect when the liquid of said recovery tank reaches a predetermined level, said sensor including a pressure switch responsive to a pressure level associated with said predetermined liquid level in said recovery tank;

a circuit electrically connected to said sensor for generating a control signal in response to said pressure level of said recovery tank; and wherein said circuit comprises an oscillator circuit.

23. The detecting system of claim 22 wherein said suction cleaner includes a base for movement along a surface, a handle pivotally connect to said base, said recovery tank being removably mounted to one of said base and said handle, said suction cleaner further including a solution tank for holding cleaning solution, a distributor fluidly connected to said tank for distributing cleaning solution on the surface.

24. A detecting system for a suction cleaner comprising:

a first sensor mounted to the cleaner and positioned to detect the moisture level of a cleaning surface;

a circuit electrically connected to the first sensor for generating a first control signal in response to the detected moisture level of the cleaning surface;

a tank removably mounted to said suction cleaner for containing liquid;

a second sensor mounted to the cleaner to detect when the liquid of said tank reaches a predetermined level;

wherein said circuit is electrically connected to the second sensor for generating a second control signal in response to the detected liquid level of said tank; and a switching transistor being operatively connected to said lamp and said circuit, wherein said circuit outputs said second control signal to turn on said switching transistor which causes said lamp to illuminate.

25. The detecting system of claim 24 wherein said circuit includes a comparator circuit section for outputting said second control signal, said comparator circuit section being operatively connected to said switching transistor.

26. The detecting system of claim 24 wherein said suction cleaner includes a base for movement along a surface, a handle pivotally connect to said base, said recovery tank being removably mounted to one of said base and said handle, said suction cleaner further including a solution tank for holding cleaning solution, a distributor fluidly connected to said solution tank for distributing cleaning solution on the surface.

27. A detecting system for a suction cleaner comprising:

a first sensor mounted to the cleaner and positioned to detect the moisture level of a cleaning surface;

a circuit electrically connected to the first sensor for generating a first control signal in response to the detected moisture level of the cleaning surface;

a tank removably mounted to said suction cleaner for containing liquid;

a second sensor mounted to the cleaner to detect when the liquid of said tank reaches a predetermined level;

wherein said circuit is electrically connected to the second sensor for generating a second control signal in response to the detected liquid level of said tank; and wherein said circuit comprises an oscillator circuit.

28. The detecting system of claim 27 wherein said suction cleaner includes a base for movement along a surface, a handle pivotally connect to said base, said recovery tank being removably mounted to said base, said suction cleaner further including a solution tank for holding cleaning solution, a distributor fluidly connected to said tank for distributing cleaning solution on the surface.

29. A detecting system for a suction cleaner comprising:

a first sensor mounted to the cleaner and positioned to detect the moisture level of a cleaning surface;

a circuit electrically connected to the first sensor for generating a first control signal in response to the detected moisture level of the cleaning surface;

a tank removably mounted to said suction cleaner for containing liquid;

a second sensor mounted to the cleaner to detect when the liquid of said tank reaches a predetermined level; and wherein said circuit is electrically connected to the second sensor for generating a second control signal in response to the detected liquid level of said tank, said circuit includes a microprocessor coupled to said first sensor and said second sensor.

30. The detecting system of claim 29 wherein said microprocessor is mounted to a printed circuit board.

* * * * *